US011311449B1

(12) United States Patent
Razon

(10) Patent No.: US 11,311,449 B1
(45) Date of Patent: Apr. 26, 2022

(54) SINGLE INCAPACITATED LEG BODY CRUTCH WITH LATERAL GAIT MOVEMENT

(71) Applicant: Eli Razon, Maple Glen, PA (US)

(72) Inventor: Eli Razon, Maple Glen, PA (US)

( * ) Notice: Subject to any disclaimer, the term of this patent is extended or adjusted under 35 U.S.C. 154(b) by 79 days.

(21) Appl. No.: 16/785,581

(22) Filed: Feb. 8, 2020

Related U.S. Application Data

(63) Continuation-in-part of application No. 16/586,266, filed on Sep. 27, 2019.

(60) Provisional application No. 62/739,255, filed on Sep. 30, 2018.

(51) Int. Cl.
*A61H 3/02* (2006.01)
*A61H 3/00* (2006.01)

(52) U.S. Cl.
CPC ..... *A61H 3/02* (2013.01); *A61H 3/0277* (2013.01); *A61H 2003/005* (2013.01); *A61H 2003/007* (2013.01); *A61H 2201/0165* (2013.01); *A61H 2201/0192* (2013.01); *A61H 2201/1246* (2013.01); *A61H 2201/1621* (2013.01); *A61H 2201/1635* (2013.01); *A61H 2201/1647* (2013.01)

(58) Field of Classification Search
CPC ... A61H 3/02; A61H 3/0277; A61H 2003/005
See application file for complete search history.

(56) References Cited

U.S. PATENT DOCUMENTS

| | | | | | |
|---|---|---|---|---|---|
| 2,678,054 | A * | 5/1954 | Bostelman | A61H 3/02 | 135/68 |
| 2,707,962 | A * | 5/1955 | Yandow | A61H 3/00 | 135/69 |
| 4,291,715 | A * | 9/1981 | Monte | A61H 3/02 | 135/68 |
| 10,624,810 | B2 * | 4/2020 | Hunter | A61H 3/0288 | |
| 2007/0012345 | A1 * | 1/2007 | Owens | A61H 3/02 | 135/69 |
| 2009/0165834 | A1 * | 7/2009 | West | A61H 3/02 | 135/65 |
| 2009/0229643 | A1 * | 9/2009 | Ramm | A61H 3/02 | 135/69 |
| 2013/0184616 | A1 * | 7/2013 | Sanders | A61H 3/06 | 601/33 |
| 2013/0226058 | A1 * | 8/2013 | Sanders | A61F 5/0102 | 602/23 |
| 2014/0096804 | A1 * | 4/2014 | Keck | A61H 3/02 | 135/69 |

* cited by examiner

*Primary Examiner* — Noah Chandler Hawk

(57) ABSTRACT

A single incapacitated leg crutch for use by a person with a single incapacitated leg is provided with features for user friendly attachment and release of the crutch. The single incapacitated leg crutch includes features for controlled limitation of lateral and forward gait movement and gait walking stabilization that occurs in natural lateral and forward walking gait motion without a crutch.

11 Claims, 22 Drawing Sheets

11

Z
Y
X
14b
14a
12a
14
16c
16
16b
12b
16a
12
18
18a
18b
12c
A50
22
50
50a
50d
A50
G

11
Z
X
Y 12a
14
14a
16b
16c
12b
16a
16
18
18b
18a'
12c
64a
63a
62
18a
64
64b
63b
50a
58a
12e
52a
52'
A
50
56a
G
50
50c
50b
56a
22c
22a
22b
22
56

11
Z
X
Y 14
14a
14a
16c
12b
16a
16b
18
18b
18a
62a
62
60
63b
52a
50
58a
58a
56a
22b
56a
G
22

90
14
16a
12
18a
22b
G
A16
X14
X16

Z
X
Y
90
14
16
16c
16a
12
18a
32
20
22'
22a
G
$A_{LG}$

SINGLE INCAPACITATED LEG BODY CRUTCH WITH LATERAL GAIT MOVEMENT

CROSS REFERENCE TO RELATED APPLICATIONS

This application is a continuation-in-part of application Ser. No. 16/586,266 filed Sep. 27, 2019, which application claims the benefit of United States Provisional Patent Application No. 62/739,255 filed Sep. 30, 2018, both of which applications are incorporated herein by reference in their entireties.

FIELD OF THE INVENTION

The present invention relates to a single incapacitated leg body crutch with lateral gait movement were the incapacitated leg cannot make weight bearing contact with the walking surface.

The present invention relates to an assisted walking device for a human experiencing at least one-sided partial paralysis or weakness where the device employs a simple user friendly installation and provides controlled limited lateral gait movement while walking.

BACKGROUND OF THE INVENTION

At one end of the spectrum of single leg body crutches, there is a multitude of sophisticated prior art where the incapacitated leg makes minimal load bearing contact with the walking surface. At the other end of the spectrum of single leg crutches, there is a multitude of crutches that transfer weight from the incapacitated leg to a leg body crutch in which the incapacitated leg is seated and the single leg body crutch makes load bearing contact with the walking surface but does not provide for lateral gait movement.

It is one object of the present invention to provide a single leg body crutch that transfers weight from the incapacitated leg to a leg body crutch in which the incapacitated leg is seated and the single leg body crutch makes load bearing contact with the walking surface while providing for lateral gait movement.

BRIEF SUMMARY OF THE INVENTION

In one aspect the present invention is a single leg body crutch that transfers weight from the incapacitated leg to a leg body crutch in which the incapacitated leg is seated and the single leg body crutch makes load bearing contact with the walking surface while providing for lateral gait movement.

The above and other aspects of the invention are set forth in this specification and the appended claims.

BRIEF DESCRIPTION OF THE DRAWINGS

The appended drawings, as briefly summarized below, are provided for exemplary understanding of the invention, and do not limit the invention as further set forth in this specification and the appended claims.

DETAILED DESCRIPTION OF THE INVENTION

Figure 1:
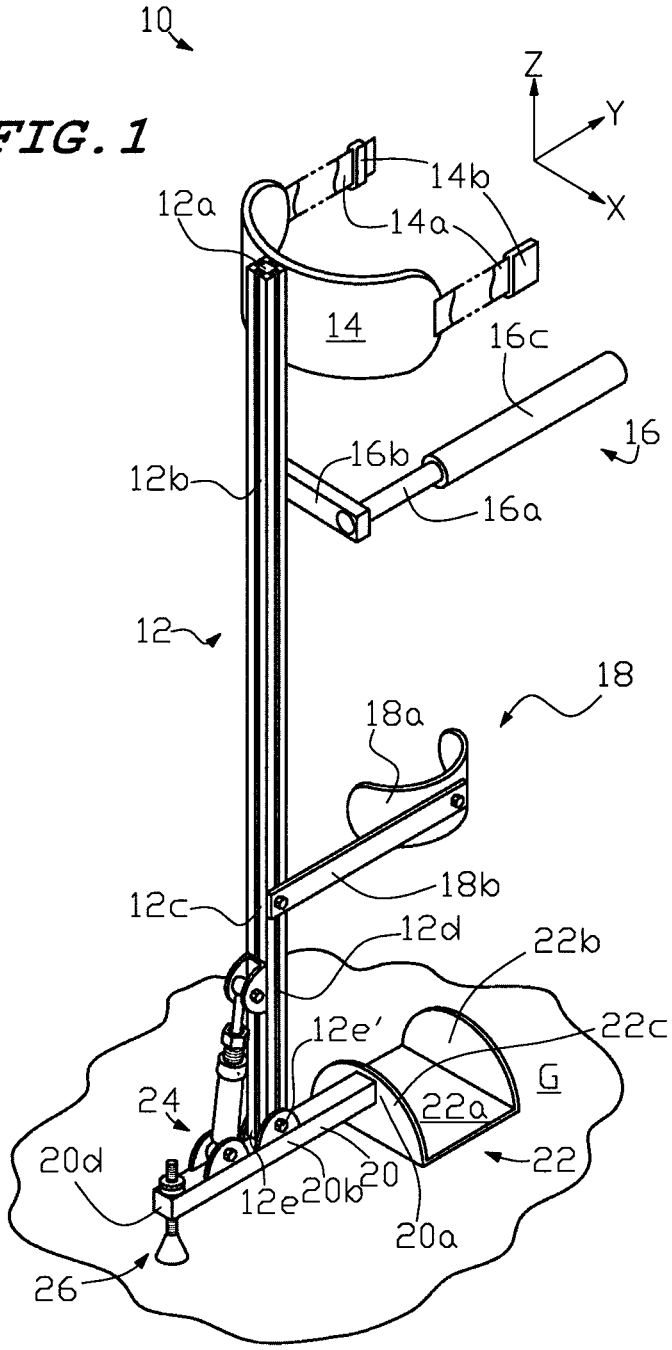
FIG. 1 is a perspective view of one embodiment of an assisted walking device of the present invention.

Three-dimensional Cartesian space is established in the drawings for convenience of describing relative locations and movements of the disclosed assisted walking device's components.

There is shown in FIG. 1 through FIG. 4 one embodiment of an assisted walking device 10 of the present invention.

Vertically oriented support rod 12 is configured for the attachment of the components of the human assisted walking device shown in the figures. In some embodiments of the invention, the vertically oriented support rod may be of a fixed overall vertical height as required for a particular user of the device. In some embodiments of the invention, vertically oriented support rod 12 is a vertical linear length of rectangular extruded aluminum T-slot structural frame configured for use with interlocking fittings for attachment of the components. In other embodiments, the vertically oriented support rod is adjustable in overall vertical height; for example, by being formed from two or more tubular sections that telescope into and out of each other to a lockable variable vertical height as required by a particular user. In some embodiments of the invention, the vertically oriented support rod may include one or more curved sections to accommodate a particular user's body shape or posture.

An upper body retainer 14 is attached at or near to the upper vertical end 12*a* of vertically oriented support rod 12 and is either fixed in location to the vertically oriented support rod with a suitable upper body retaining fastener or configured for fixing to an adjustable location along the vertical height of the vertically oriented support rod with a fastener tightening element that can be located relative to the interior or exterior of the upper body retaining fastener. In some embodiments of the invention, the attachment of the upper body retainer 14 to vertically oriented support rod 12 allows rotation of the vertically oriented support rod around the attachment in an X-Z plane when the device 10 is in use so that the vertically oriented support rod rotates independent of the attached upper body retainer. Upper body retainer 14 extends at least partially around the girth of a user's chest region to secure the user in the forward (+X) walking direction and rearward (−X) standing direction when walking with the device. In some embodiments of the invention the upper body retainer is formed from an arcuate shaped soft injection molded polymer material with expanding elasticity to comfortably secure a variable range of chest girths where the upper body retainer is positioned when in use.

In some embodiments of the invention optional chest belt 14*a*, either of adjustable length or fixed length, is configured with a belt fastener 14*b*, such as a snap-fit buckle so that the upper body retainer remains firmly attached to the user's chest when walking by securing the upper body retainer around the entire girth of the user.

Hand grip assembly 16 is attached at position 12*b* to vertically oriented support rod 12 below upper body retainer 14 and is either securely fixed in a location to the vertically oriented support rod or configured for secured fixing to an adjustable vertical height location to the vertically oriented support rod. Hand grip 16*a* extends forward (+X direction) of the vertically oriented support rod with inward end attachment to hand grip forward extender 16*b*. Hand grip forward extender 16*b* can be configured for the optional adjustable vertical height location or an optional forward (+X direction) and rearward (−X direction) adjustment of hand grip assembly 16 relative to the vertically oriented support rod with a fastener tightening element that can be located on hand grip 16*a*, hand grip forward extender 16*b* or vertically oriented support rod 12. Hand grip 16*a* is shown in the drawings with optional grip compression material 16*c* provided over hand grip 16*a* to allow the user to firmly compression grip the hand grip.

Knee support assembly 18 is attached at position 12*c* to vertically oriented support rod 12 below hand grip assembly 16 and is either fixed securely in location to the vertically oriented support rod, for example, with a suitable knee support fastener or configured for secured fixing to an adjustable vertical height location to the vertically oriented support rod with a fastener tightening element that can be located on knee support 18*a*, lateral (Y-direction) knee support extender 18*b* or vertically oriented support rod 12. Lateral knee support extender 18*b* may be of a fixed lateral (Y) direction length or of a variable fixed lateral direction length provided, for example, by forming the lateral knee support from two or more interconnected tubular knee support extender sections that telescope into and out of each other to a fixed lockable variable lateral position as required by the body shape of a particular user of the assisted walking device. Knee support assembly 18 assists in avoiding buckling of the user's knee joint while walking and is preferably positioned with the vertical top (at reference height 18*a*') of knee support 18*a* directly below the user's patella. Knee support 18*a* extends partially around the girth of the user's leg below the patella of the paralyzed or weakened leg when installed to secure the user's leg in the forward walking (X-direction) and lateral gait movement direction (Y) while walking and allows the user to easily remove the secured leg from the assisted walking device 10 in the rearward direction (−X) when separating from the assisted walking device. In some embodiments of the invention, knee support 18*a* is formed from an arcuate shaped soft molded polymer material with expanding elasticity to comfortably secure a variable range of leg girths below the patella when the user engages the knee support to secure the user's leg in the forward walking (X-direction) and lateral gait movement direction (Y) while walking and allows the user to easily remove the secured leg from the assisted walking device 10 in the rearward direction (−X) when separating from the assisted walking device.

Lower vertical end 12*e* of vertically oriented support rod 12 is pivotally (in the Y lateral direction) attached to lower horizontally oriented support structure 20 at rod lower pivot joint 12*e*' located along the length (in the Y direction) of lower horizontally oriented support structure 20 at approximately mid-length location 20*b* and configured to allow rotation of the vertically oriented support rod in a Y-Z plane when the user is walking with the device so that the user can experience normal lateral gait motion during a gait cycle. Rod lower pivot joint 12*e*' is either fixed at location 20*b* of the lower horizontally oriented support structure 20 or configured for fixing to an adjustable location along the length of the lower horizontally oriented support structure with a rod lower end fastener tightening element provided in combination with rod lower pivot joint 12*e'*.

As shown in the figures, attached respectively at opposing lateral (Y-direction) ends 20*a* and 20*d* of the lower horizontal horizontally oriented support structure are foot support 22 and horizontal leveler 26.

Figure 2A:
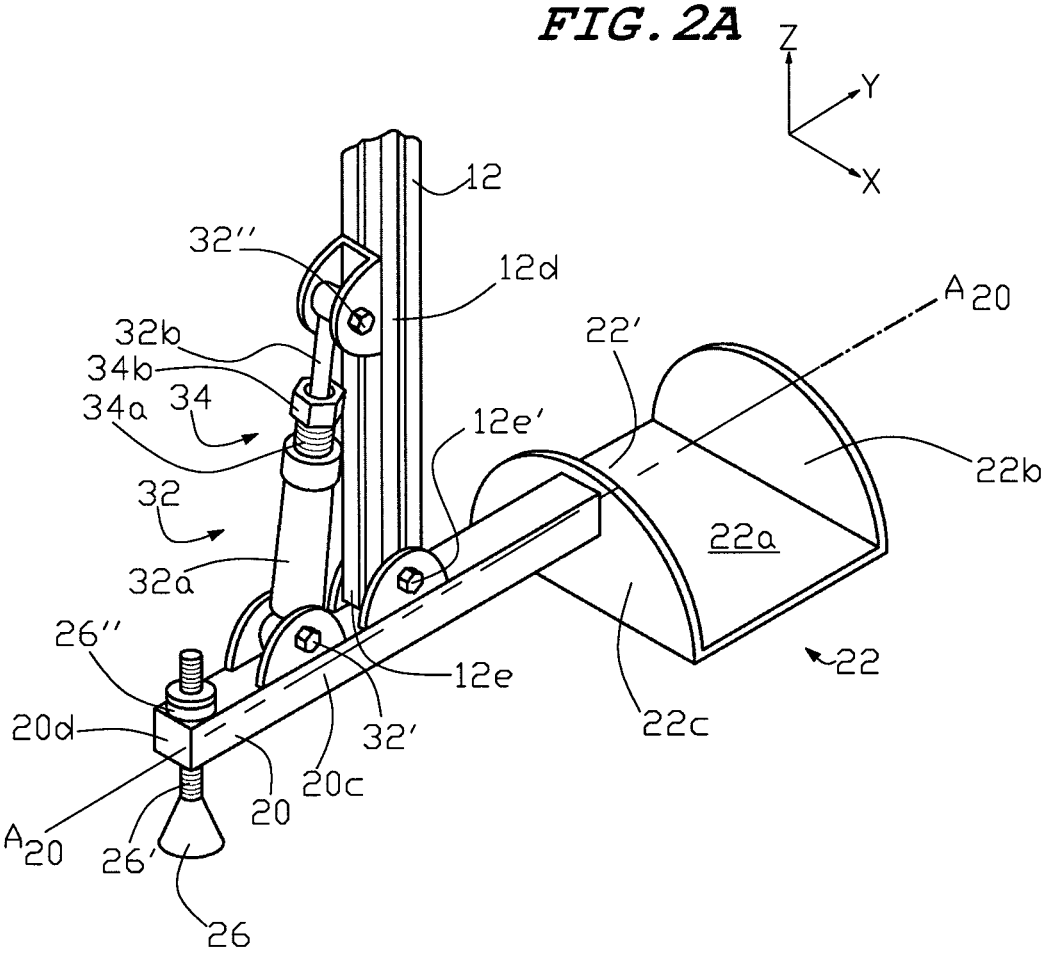
FIG. 2A is a detail view of the lower end of the assisted walking device shown in FIG. 1.
Figure 3:
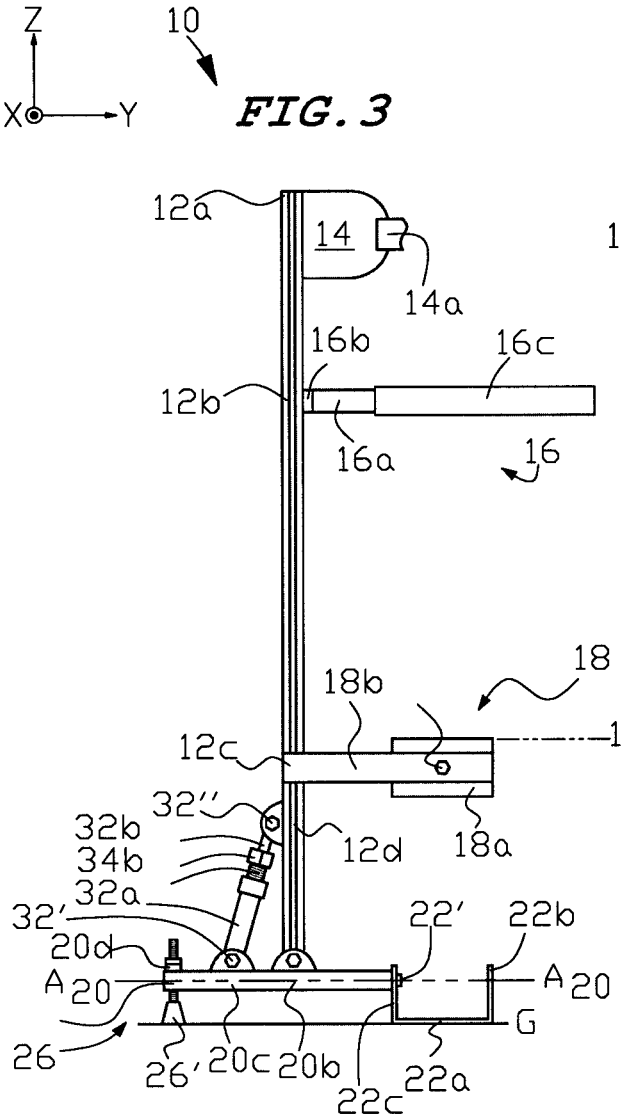
FIG. 3 is a front elevational view of the assisted walking device shown in FIG. 1.
Figure 4:
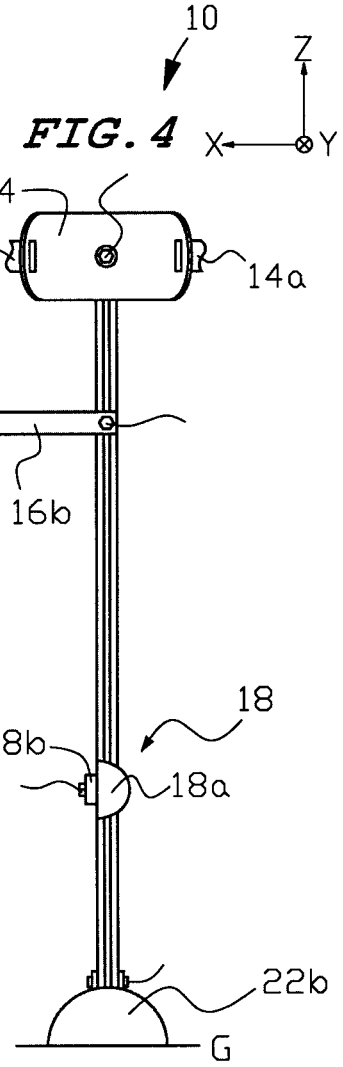
FIG. 4 is a left side elevational view of the assisted walking device shown in FIG. 1.

In some embodiments of the invention, foot support 22 for the paralyzed or weakened user's leg is configured as a foot stirrup with stirrup base 22*a* and stirrup outside and inside side walls 22*b* and 22*c*, respectively, with an open stirrup top for easy positioning of the user's leg in the stirrup and release from the stirrup. The base and side walls of the foot stirrup form a foot seating volume in which the user's foot is positioned while the device is being employed. The inside side wall 22*c* of the foot support is pivotally attached to inner end 20*a* of the lower horizontally oriented support structure 20 by pivot joint 22' as best seen in FIG. 3. Pivot joint 22' is configured to allow rotation of foot support 22, with the user's foot positioned in it during use, about longitudinal axis $A_{20}$ of lower horizontally oriented support structure 20 in an X-Z plane independent of the horizontally oriented support structure 20 as shown in FIG. 2A and FIG. 3. The base and side walls of the foot support are configured so that the foot seating volume comfortably seats the user's foot in cross sectional alignment with longitudinal axis $A_{20}$ when the user is walking in device 10 so that the user experiences a normal gait cycle movement of the foot when walking with the assistance of the device.

Figure 2B:
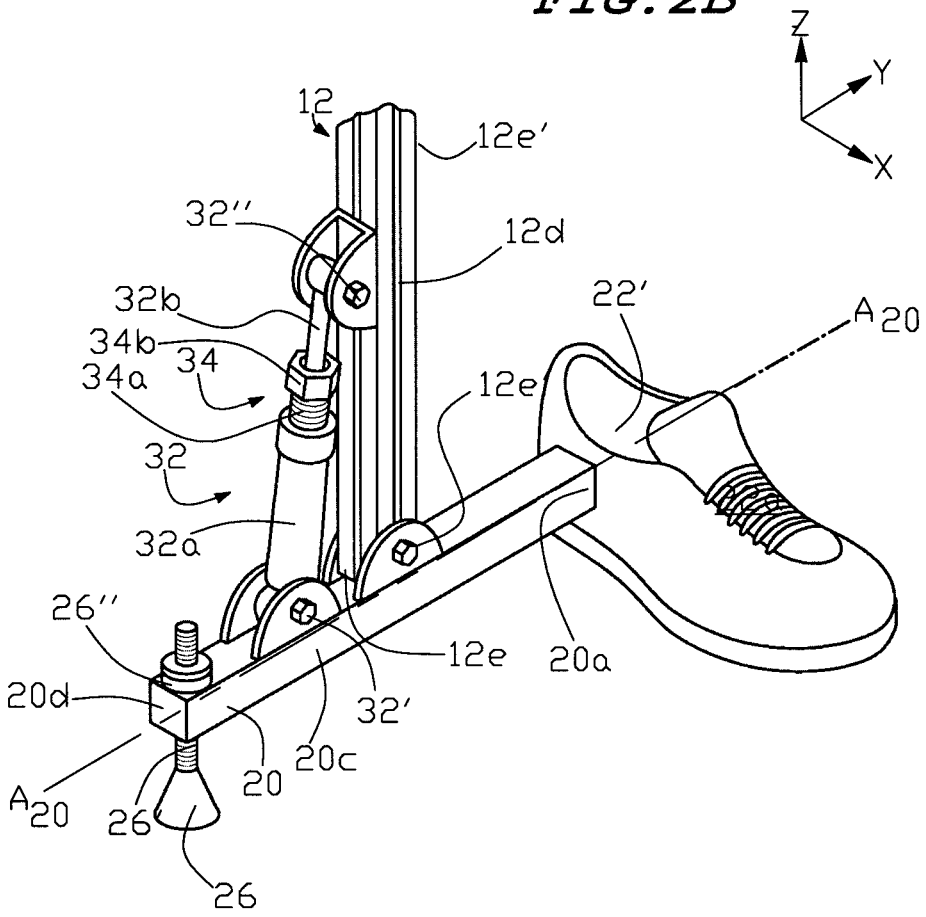
FIG. 2B is a detail view of the lower end of an alternative embodiment of the assisted walking device shown in FIG. 1.

In other embodiments of the invention, foot support 22 is footwear, for example, athletic shoe 23 shown in alternative detail embodiment FIG. 2B of device 10. The foot support, for example the stirrup or footwear, can be manufactured by computer integrated design and manufacturing methods known in the art and can be provided with a complimentary fastening element that joins to a complimentary fastening element at inner end 20*a* of the horizontally oriented support structure 20 to form pivot joint 22' at inner end 20*a* to provide the user's foot movement as disclosed when the foot support, for example a foot stirrup or footwear, is being used.

Vertically oriented support rod lower pivot joint 12*e*' allows vertically oriented support rod 12 to rotate in a Y-Z plane when the user's paralyzed or weakened side is positioned in upper body retainer 14, knee support assembly 18 and foot support 22 with lateral direction gait movement that would naturally occur in a normal human gait walking cycle if assisted walking device 10 was not being used. However if this lateral direction gait movement is overextended, the user would be susceptible to falling laterally (Y-direction) without the ability to recover to upright position due to the at least one sided paralysis or weakness. To aid in avoiding lateral falling while allowing a controlled angle of gait rotation in lateral (−Y direction) assisted walking device 10 includes an active lateral gait force limit assembly. In some embodiments of the invention, the active lateral gait force limit assembly is a mechanical damper, for example a dashpot, or a pneumatic or hydraulic damper, as known in the art, in combination with a lateral motion limit device. In the embodiment of the invention shown in FIG. 1 to FIG. 4, pneumatic or hydraulic damper 32 is shown with monotube or twin tube gas or hydraulic cylinder 32*a* with damper rod 32*b* extending externally from the cylinder through lateral motion limit device 34 as best seen in FIG. 2A. In this embodiment of the invention, lateral motion limit device 34 comprises externally screw threaded pipe 34*a* joined at the end of the cylinder from which damper rod 32*b* extends and threaded lateral motion limit nut 34*b* that is adjustably screwed onto externally screw threaded pipe 34*a*. The final adjusted fixed position of nut 34*b* along the screw thread determines the maximum permissible lateral gait angle on the paralyzed or weakened side of the user. In the embodiment of the invention for assisted walking device 10 as shown in FIG. 1 to FIG. 4, the cylinder end opposite the end of the externally extended cylinder rod 32*b* is pivotally (in the Y lateral direction) attached to lower horizontally oriented support structure 20 by damper pivot joint 32' located along the length of lower horizontally oriented support structure 20 at location 20*c*, which is laterally outward of the rod lower end pivot joint 12*e*'. The externally extended end of damper rod 32*b* is pivotally (in the Y direction) attached to vertically oriented support rod 12 by damper pivot joint 32" located along the length of the vertically oriented support rod 12 at location 12*d* below location 12*c* at which knee support assembly 18 is located.

Figures 11A, 11B, 11C:
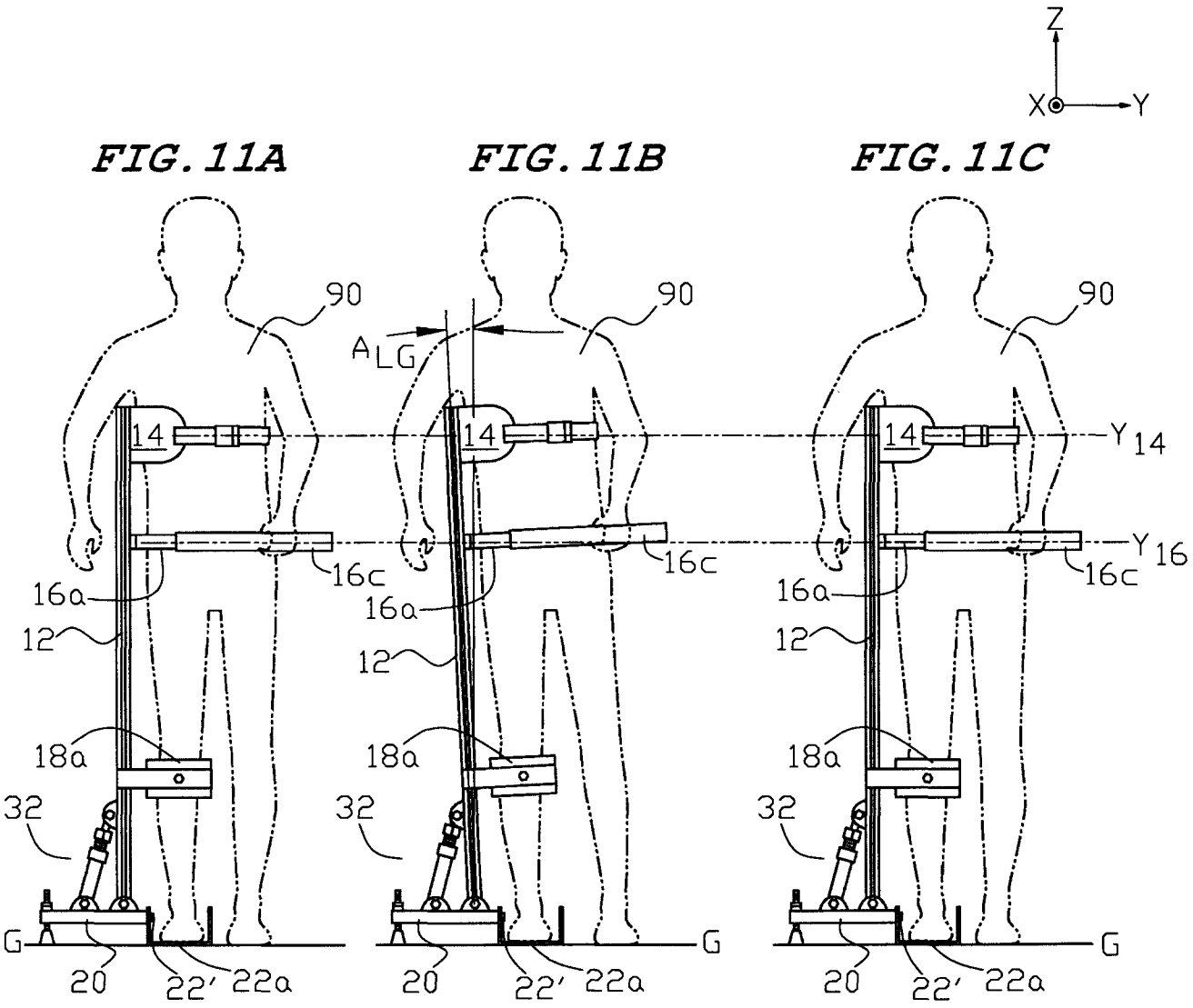
FIGS. 11A, 11B and 11C are front elevation views corresponding to the side elevation views in FIGS. 10A, 10B and 10C of employment of the assisted walking device in FIG. 9 with the person walking forward through a gait cycle with the assisted walking device.

When vertically oriented support rod 12 is at vertical (oriented parallel with the Z-axis), as shown for example in FIG. 1, damper 32 is configured so that cylinder rod 32*b* is at fully extended (external) stroke. When a user walks with assisted walking device 10, during gait cycle lateral (Y) motion to the right side of vertical (the side of paralysis or weakness in this example), externally extended damper rod 32*b* is forced into cylinder 32*a* to a maximum lateral gait angle when the external end of damper rod 32*b* makes contact with threaded lateral motion limit nut 34*b*. Consequently the user's lateral (−Y direction) gait motion is limited to the maximum lateral angle, for example angle $A_{LG}$ from vertical as shown in FIG. 11B, which is established by the final adjusted position of the threaded lateral motion limit nut 34*b* on the externally screw threaded pipe, and externally extended damper rod 32*b* will return the vertically oriented support rod 12 to vertical orientation as the user returns to zero degrees lateral gait angle when the vertically oriented support rod 12 is at vertical orientation.

Horizontal leveler 26 is attached to outer end 20*d* of lower horizontally oriented support structure 20 and is either fixed in vertical (Z direction) distance from the bottom of the lower horizontal support structure to ground level G, or configured for secured fixing to an adjustable vertical distance with a leveler fastener tightening element that can be located above or below the lower horizontal support structure, such as adjustable threaded rod 26' attached to leveler 26 and nut 26" attached to the horizontally oriented support structure. In some embodiments of the invention, horizontal leveler 26 is bell-shaped and maintains the lower horizontally oriented support structure horizontally oriented as the user moves through a gait cycle. In some embodiments of the invention, horizontal leveler 26 is formed from a soft high elasticity polymer that is a passive lateral (Y) direction damper that functions in conjunction with the active lateral gait force damper to limit lateral gait motion.

There is shown in FIG. 5 through FIG. 8 another embodiment of an assisted walking device 11 of the present invention. Assisted walking device 11 is similar in part with assisted walking device 10 as described herein.

Vertically oriented support rod 12 is configured for the attachment of the components of the human assisted walking device shown in the figures. In some embodiments of the invention, the vertically oriented support rod may be of a fixed overall vertical height as required for a particular user of the device. In some embodiments of the invention, vertically oriented support rod 12 is a vertical linear length of rectangular extruded aluminum T-slot structural frame configured for use with interlocking fittings for attachment of the components. In other embodiments, the vertically oriented support rod is adjustable in overall vertical height; for example, by being formed from two or more tubular sections that telescope into and out of each other to a lockable variable vertical height as required by a particular user. In some embodiments of the invention the vertically oriented support rod may include one or more curved sections to accommodate a particular user's body shape or posture.

An upper body retainer 14 is attached at or near to the upper vertical end 12*a* of vertical support rod 12 and is either fixed in location to the vertically oriented support rod with a suitable upper body retainer fastener or configured for fixing to an adjustable location along the vertical height of the vertically oriented support rod with a fastener tightening element that can be located relative to the interior or exterior of the upper body retainer. In some embodiments of the invention, the attachment of the upper body retainer 14 to vertically oriented support rod 12 allows rotation of the vertically oriented support rod around the attachment in an X-Z plane when the device 10 is in use so that the vertically oriented support rod rotates independent of the attached upper body retainer. Upper body retainer 14 extends partially around the girth of a user's chest region to secure the user in the forward (+X) walking direction and rearward (−X) standing direction when walking with the device. In some embodiments of the invention the upper body retainer is formed from an arcuate shaped soft injection molded polymer material with expanding elasticity to comfortably secure a variable range of chest girths where the upper body retainer is positioned when in use.

In some embodiments of the invention optional chest belt 14*a*, either adjustable length or fixed length, is configured with a belt fastener 14*b*, such as a snap-fit buckle so that the upper body retainer remains firmly attached to the user's chest when walking by securing the upper body retainer around the entire girth of the user.

Hand grip assembly 16 is attached at position 12*b* to vertically oriented support rod 12 below upper body retainer 14 and is either securely fixed in a location to the vertically oriented support rod or configured for secured fixing to an adjustable vertical height location to the vertically oriented support rod. Hand grip 16*a* extends forward (+X direction) of the vertically oriented support rod with inward end attachment to hand grip forward extender 16*b*. Hand grip forward extender 16*b* can be configured for the optional adjustable vertical height location or an optional forward (+X direction) and rearward (−X direction) adjustment of hand grip assembly 16 relative to the vertically oriented support rod with a fastener tightening element that can be located on hand grip 16*a*, hand grip forward extender 16*b* or vertically oriented support rod 12. Hand grip 16*a* is shown in the drawings with optional grip compression material 16*c* provided over hand grip 16*a* to allow the user to firmly compression grip the hand grip.

Knee support assembly 18 is attached at position 12*c* to vertically oriented support rod 12 below hand grip assembly 16 and is either securely fixed in a location to the vertically oriented support rod, for example, with a suitable knee fastener or configured for secured fixing to an adjustable vertical height location to the vertically oriented support rod with a fastener tightening element that can be located on knee support 18*a*, lateral (Y direction) knee support extender 18*b* or vertically oriented support rod 12. Lateral knee support extender 18*b* may be of a fixed lateral (Y) direction length or of a variable fixed lateral direction length provided, for example, by forming the lateral knee extender from two or more interconnected tubular knee extender sections that telescope into and out of each other to a fixed lockable variable lateral position as required by the body shape of a particular user of the assisted walking device. Knee support assembly 18 assists in avoiding buckling of the user's knee joint while walking and is preferably positioned with the vertical top of knee support 18*a* directly below the user's patella. Knee support 18*a* extends partially around the girth of the user's leg below the patella of the paralyzed or weakened leg when installed to secure the user's leg in the forward walking (X direction) and lateral gait movement (Y direction) while walking and allowing the user to easily remove the secured leg from the assisted walking device 11 in rearward direction (−X) when separating from the assisted walking device. In some embodiments of the invention, knee support 18*a* is formed from an arcuate shaped soft molded polymer material with expanding elasticity to comfortably secure a variable range of leg girths below the patella when the user engages the knee support.

Figure 13A:
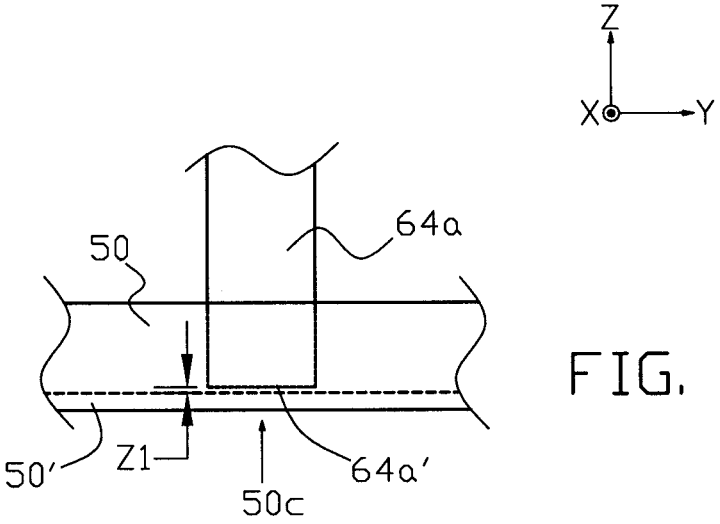
FIGS. 13A and 13B illustrate limited maximum one sided lateral gait angle control provided by the assisted walking device illustrated in FIG. 5 through FIG. 8.
Figure 13B:
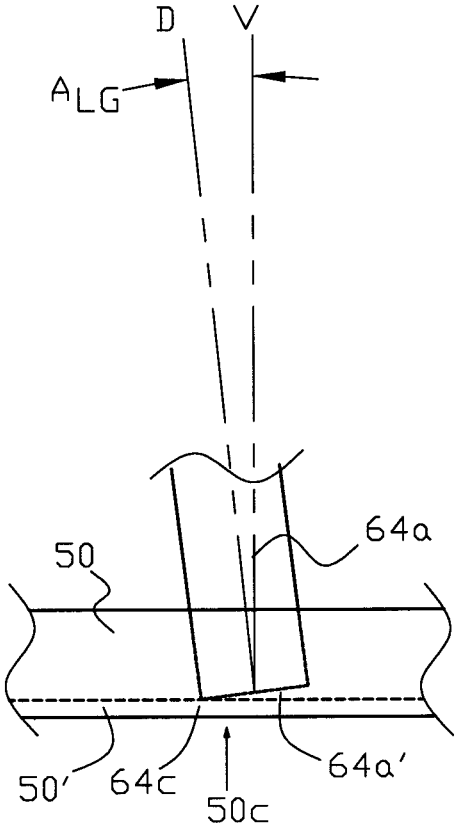

As shown in FIG. 5 through FIG. 8, attached respectively at opposing lateral (Y-direction) inner end 50*a* and outer end 50*d* of lower horizontally oriented support structure 50 are foot support 22 and horizontal leveler assembly 56. In the embodiment of the invention shown in the figures, lower horizontally oriented support structure 50 comprises an open interior rectangular bar forming a "U" shaped cross section in an X-Z plane with bottom base 50' shown in detail FIG. 13A and FIG. 13B. "U" shaped lower horizontally oriented support structure 50 is formed from a suitable material such as an aluminum alloy.

Figure 6:
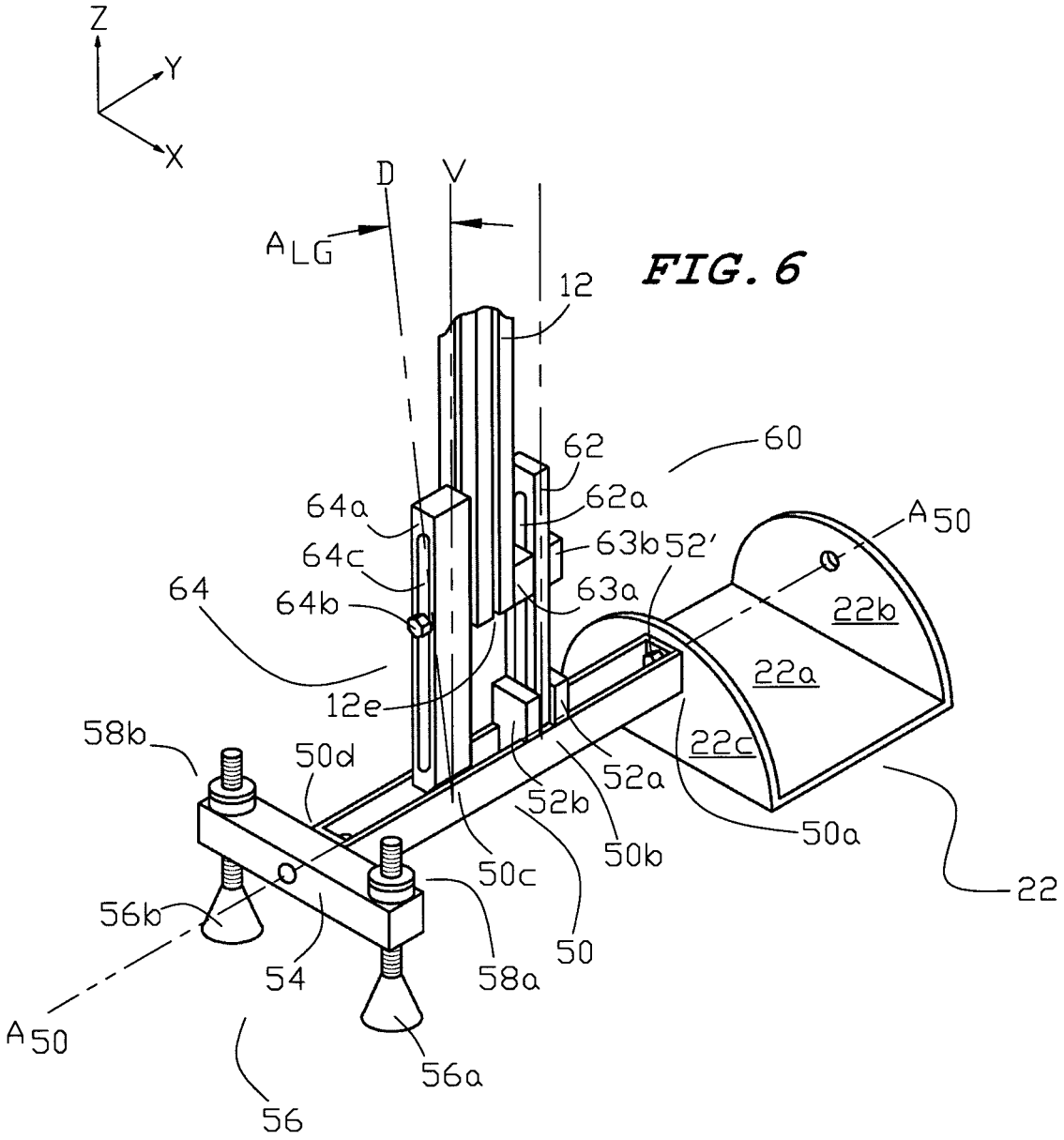
FIG. 6 is a detail view of the lower end of the assisted walking device shown in FIG. 5.
Figure 7:
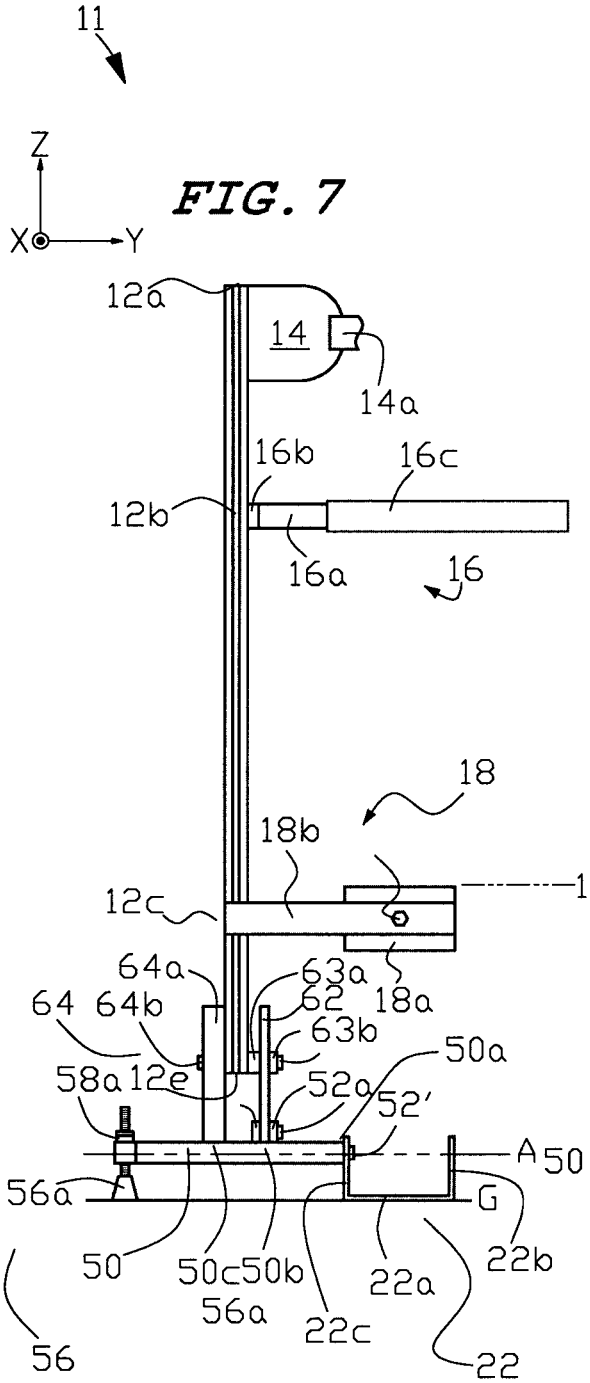
FIG. 7 is a front elevational view of the assisted walking device shown in FIG. 5.
Figure 8:
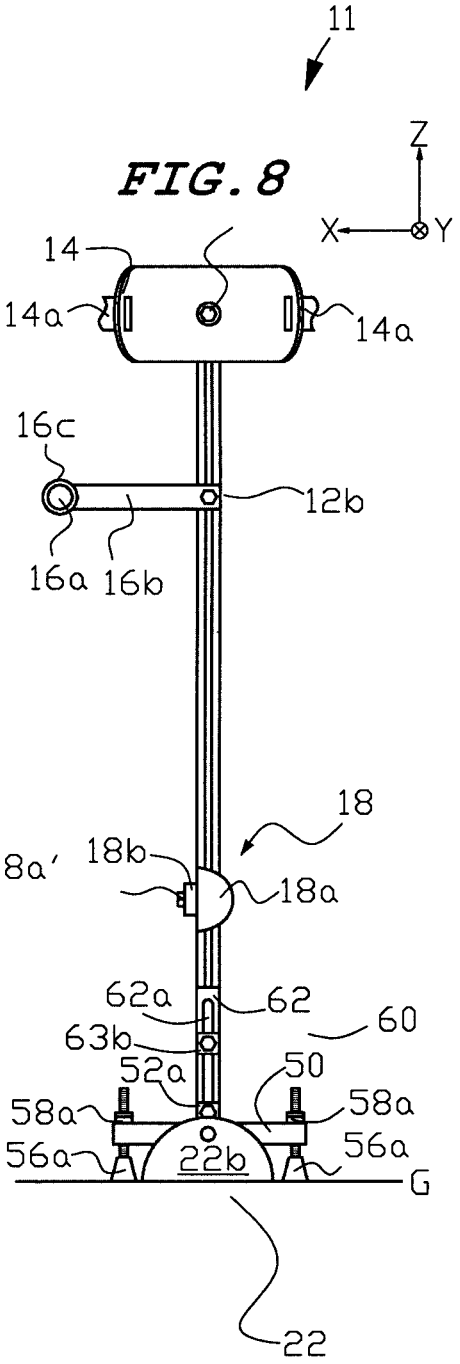
FIG. 8 is a left side elevational view of the assisted walking device shown in FIG. 5.

In some embodiments of the invention, foot support 22 for the paralyzed or weakened user's leg is configured as a foot stirrup with stirrup base 22*a* and stirrup outside and inside side walls 22*b* and 22*c*, respectively, with an open stirrup top for easy positioning of the user's leg in the stirrup and release from the stirrup. The base and side walls of the foot stirrup form a foot seating volume in which the user's foot is positioned while the device is being employed. The inside side wall of the foot support is pivotally attached to inner end 50*a* of the lower horizontally oriented support structure 50 by pivot joint 52' as best seen in FIG. 6 and FIG. 7. Pivot joint 52' is configured to allow rotation of foot support 22, with the user's foot positioned in it during use, about longitudinal axis $A_{50}$ of lower horizontally oriented support structure 50 in an X-Z plane independent of the horizontally oriented support structure 50 as shown in FIG. 6 and FIG. 7. The base and side walls of the foot support are configured so that the foot seating volume comfortably seats the user's foot in cross sectional alignment with longitudinal axis $A_{50}$ when the user is walking in device 11 so that the user experiences a normal gait cycle movement of the foot when walking with the assistance of the device.

In other embodiments of the invention, foot support 22 is footwear, for example, athletic footwear as illustrated in FIG. 2B for the assisted walking device 10 that is also applicable to assisted walking device 11. The foot support, for example the stirrup or footwear, can be manufactured by computer integrated design and manufacturing methods known in the art and can be provided with a complimentary fastening element that joins to a complimentary fastening element at inner end 50*a* of the horizontally oriented support structure 50 to form pivot joint 52' at inner end 50*a* to provide the user's foot movement as disclosed when foot support, for example a foot stirrup or footwear, is being used.

Lower vertical end 12*e* of vertically oriented support rod 12 is attached between lateral gait movement spring assembly 60 that, in this example of the invention, comprises mono-leaf spring 62 and lateral gait movement limit device 64 as best seen in detail FIG. 6 that form an active lateral gait force damper to limit lateral gait motion in assisted walking device 11.

In the embodiment of the invention shown in the figures, mono-leaf spring 62 comprises a flat rectangular elastic material with spring interior open slot 62*a*. The spring elastic material may be, for example, a fiberglass composition that bends in the Y lateral direction without deformation when the user applies a lateral gait force and returns to vertical orientation, for example in FIG. 5, when the lateral gait force is removed. The lower end of the vertically oriented mono-leaf spring 62 is fixedly located at location 50*b* along the longitudinal (Y-direction) length of lower horizontally oriented support structure 50 by being securely fitted between spring lower end holding blocks 52*a* and 52*b* that are fixedly attached to the interior of "U" shaped lower horizontally oriented support structure 50.

Figure 5:
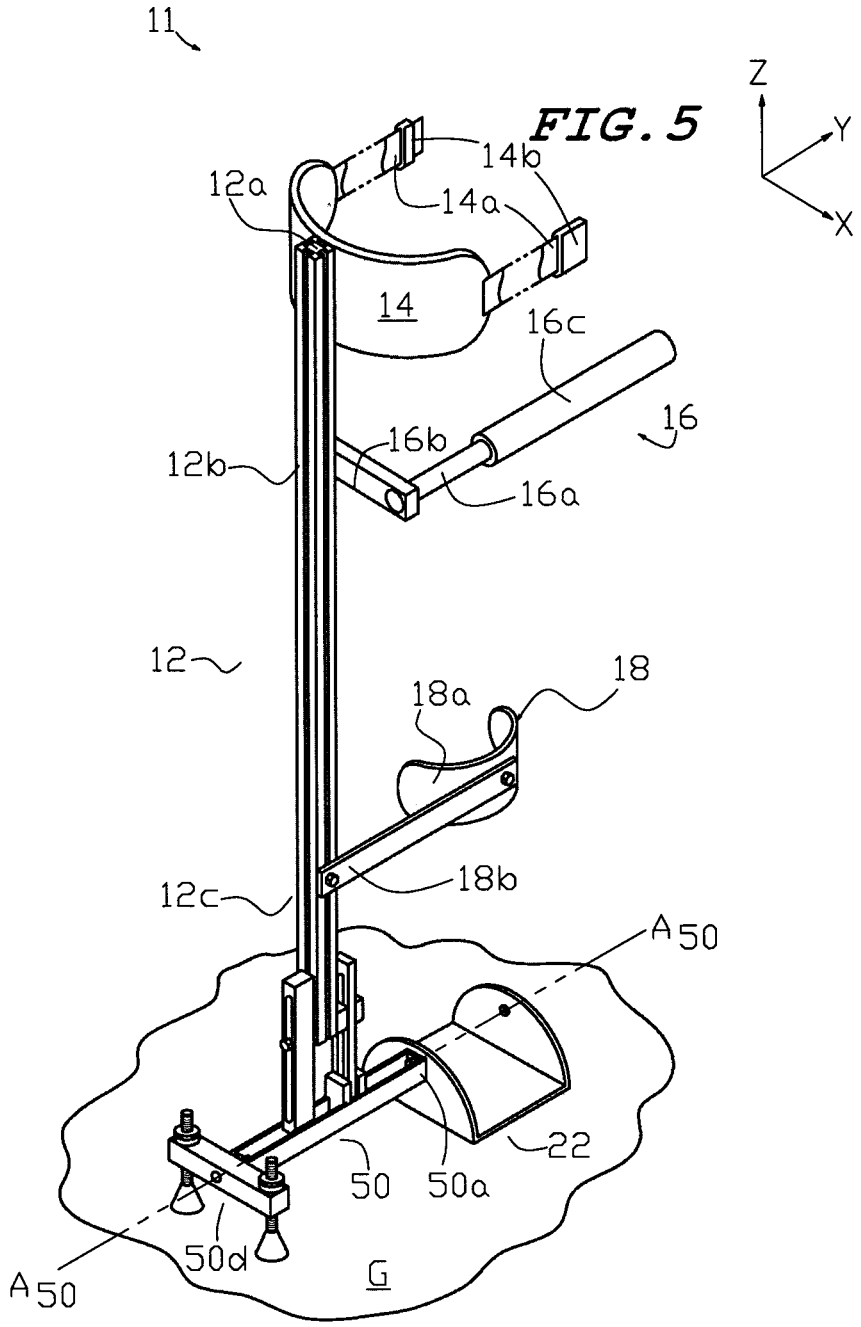
FIG. 5 is a perspective view of another embodiment of an assisted walking device of the present invention.

In the embodiment of the invention shown in the drawings, lateral gait movement limit device 64 comprises vertically oriented open interior 64*c* rectangular rigid bar 64*a* and adjustable fitting 64*b* that interconnects rigid bar 64*a* to mono-leaf spring 62 between which rigid bar 64*a* and mono-leaf spring 62 the lower end 12*e* of the vertically oriented support rod 12 is fixed. As shown in detail FIG. 13A, the surface of lower end 64*a'* of rectangular rigid bar 64*a* is horizontally offset by distance Z1 from the inner bottom 50' at location 50*c* of "U" shaped lower horizontally oriented support structure when vertically oriented support rod 12 is as shown in FIG. 5. As best seen in FIG. 6 lower end 12*e* of vertically oriented support rod 12 is fixedly located between mono-leaf spring 62 and rigid bar 64*a* with spring standoff inner and outer fittings 63*a* and 63*b* located on opposing sides of the opening in mono-leaf spring 62. In the embodiment of the invention shown in the drawings adjustable fitting 64*b* comprises a headed bolt that passes through opening 64*c* in rectangular rigid bar 64*a*, a lower end hole (not seen in the drawings) in the lower end 12*e* of vertically oriented support rod 12, hole (not seen in the drawings) in standoff inner fitting 63*a*, opening 62*a* in mono-leaf spring 62 and hole (not seen in the drawings) in standoff outer fitting 63*b*. Fastener 64*b* secures the interconnection between rectangular rigid bar 64*a* and mono-leaf spring 62 so that when a user is walking with assisted walking device 11 lateral gait movement (in −Y direction) is restricted to an adjustable angle based on where fastener 64*b* is secured along the height of the open slots in rigid bar 64*a* and mono-leaf spring 62. In the example of the invention shown in the drawings, the interconnected rigid bar 64*a*, vertically oriented support rod 12, standoff inner and outer fittings 63*a* and 63*b* and mono-leaf spring 62 will bend in the lateral direction from vertical V to lateral angle D as shown in detail FIG. 13B from vertical until the lower rectangular rigid bar end 64*c* makes contact with the inner bottom 50*c'* of "U" shaped horizontally oriented support bar 50 as illustrated in detail FIG. 12B.

Horizontal leveler bar assembly 56 is attached to outer end 50*d* of lower horizontally oriented support structure 50 and, in this example, comprises forward (+X direction) horizontal leveler 56*a* and rearward (−X direction) horizontal leveler 56*b* attached to the opposing forward and rearward ends of horizontal leveler bar 54 and are either fixed in vertical (Z) distance from the bottom of the lower horizontally oriented support structure to ground level G or configured for fixing to an adjustable vertical distance with a fastener tightening elements that can be located above or below horizontal leveler bar 54. In some embodiments of the invention, horizontal levelers 56*a* and 56*b* are bell-shaped and maintain the lower horizontally oriented support structure 50 in horizontal orientation as the user moves through a gait walking cycle. In some embodiments of the invention, horizontal levelers 56*a* and 56*b* are formed from a soft high elasticity polymer that is a passive lateral (Y) direction damper that functions in conjunction with the active lateral gait force damper to limit lateral gait motion.

Figure 9:
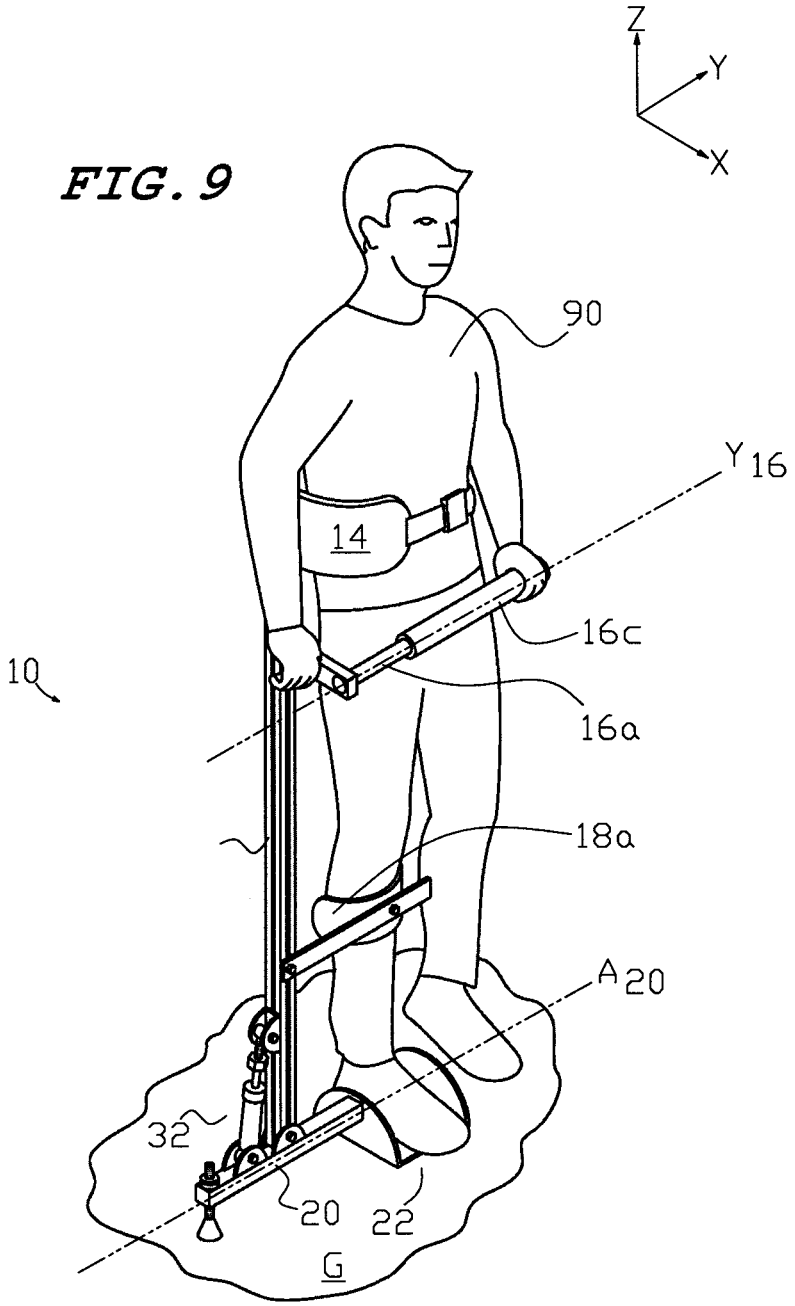
FIG. 9 is a perspective view of the assisted walking device shown in FIG. 1 and FIG. 2A with a person positioned in employment of the device for assisted walking.

FIG. 9 illustrates one example of user 90 employing the use of an assisted walking device 10 shown in FIG. 1 to FIG. 4 without external support from an external device or individual.

Figures 10A, 10B, 10C:
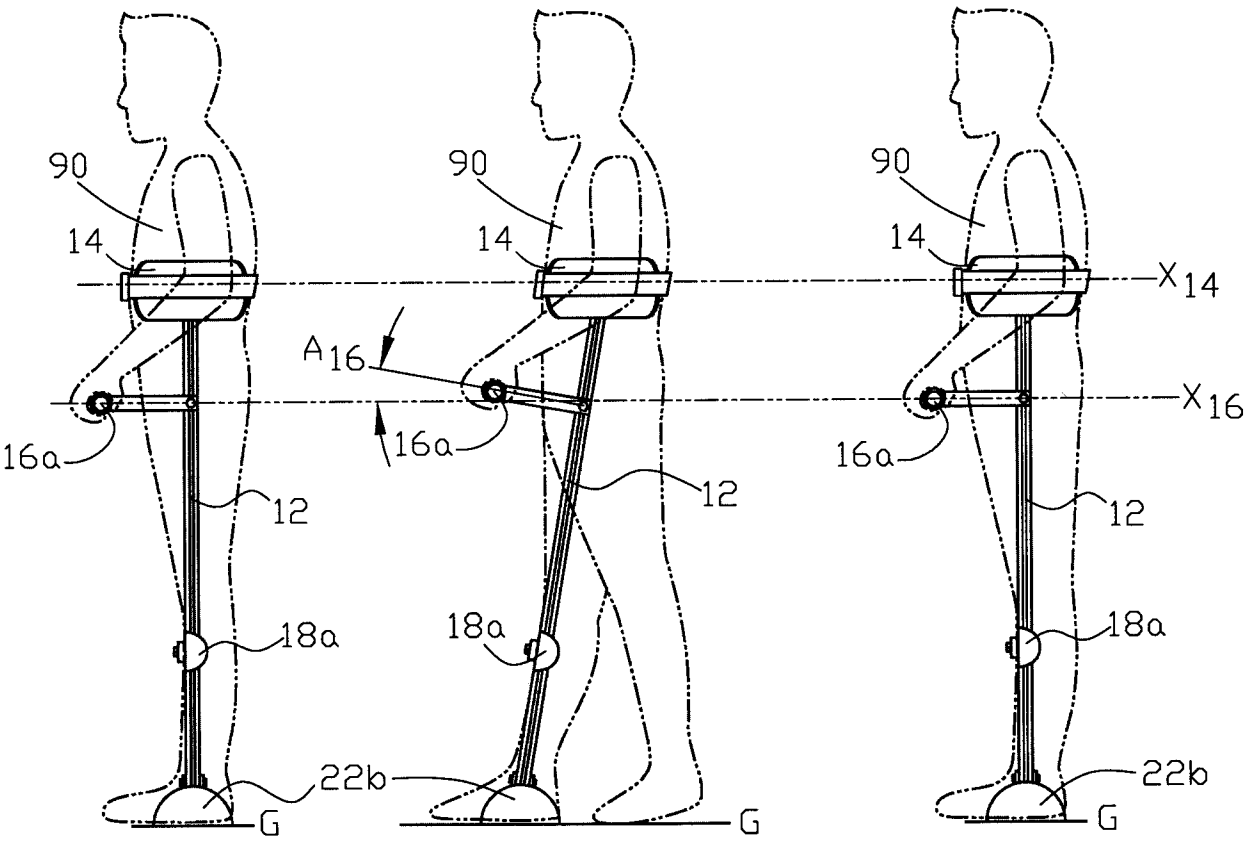
FIGS. 10A, 10B and 10C are left side elevation views of employment of the assisted walking device in FIG. 9 with the person walking forward through a gait cycle with the assisted walking device.

FIG. 10A through FIG. 10C illustrate horizontal rise and fall through the angle $A_{16}$ as the user's paralyzed or weakened one side (right side in this example) is brought forward by device 10 during a partial gait walking cycle.

FIG. 11A through FIG. 11C illustrate lateral gait angle $A_{LG}$ motion as the user's paralyzed or weakened one side is brought forward by device 10 during a partial gait walking cycle.

In FIG. 10A and FIG. 11A the user's weight is primarily over the left (non-paralyzed or non-weakened leg in this example) and the right (paralyzed or weakened leg) is not weight loaded with the user's left hand engaging hand grip 16*a* to move device 10 in the forward direction with the right leg positioned in device 10.

In FIG. 10B and FIG. 11B device 10 with the right leg pivot forward around upper body retainer 14 pivot connection to vertically oriented support rod 12. The left leg pushes forward and laterally to shift the user's weight over the right leg. Device 10 pivots laterally and forward around the horizontally oriented support structure 20 while the active lateral gait force limit assembly operates to control and limit the lateral gait movement. Knee support 18*a* prevents the user's knee joint from collapsing and maintains the user in an upright position through the gait cycle as the user's weight proceeds primarily over the right leg. Without the left leg weight loaded, the user can swing the left leg forward while the active lateral gait force limit assembly is forcing the vertically oriented support rod 12 to vertical while the user's weight shifts back to the left leg as shown in transition from FIG. 10B and FIG. 11B to FIG. 10C and FIG. 11C when a repeat forward gait cycle can be performed as shown in FIG. 10A and FIG. 11A to FIG. 10B and FIG. 11B and described herein.

The above examples of the invention describe assisted walking devices for a right side paralysis or weakness. Assisted walking devices for a left side paralysis or weakness of the present invention are mirror images devices of those disclosed for right side paralysis or weakness.

Figure 12:
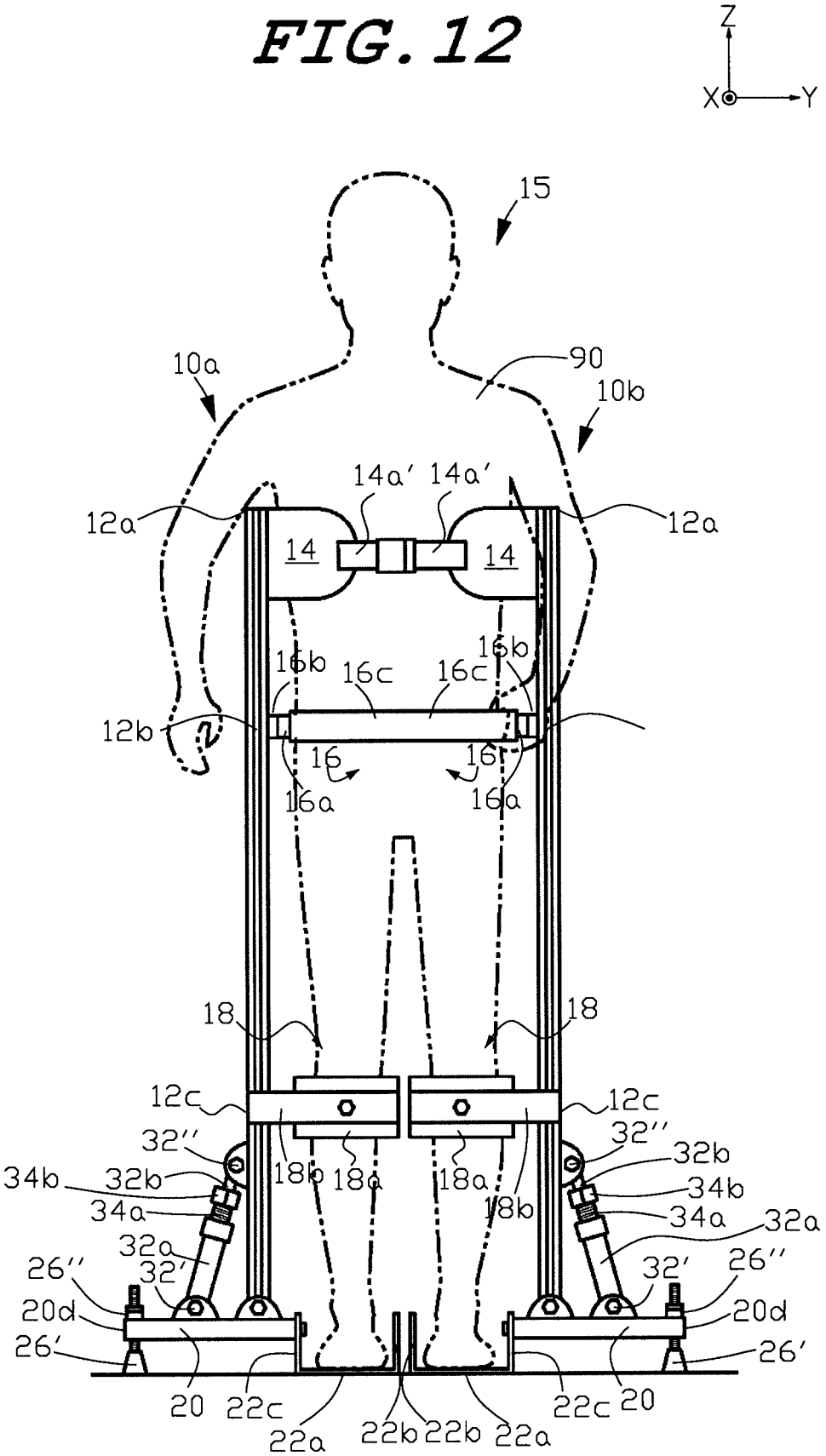
FIG. 12 is a front elevation view of another embodiment of an assisted walking device of the present invention.

In some embodiments of the invention, a right side 10*a* and a left side 10*b* assisted walking device of the present invention can be combined to form an assisted walking device of the present invention for use by a paraplegic as shown, for example, in FIG. 12. The paraplegic human assisted walking device 15 in FIG. 12 comprises a combination of a right body side 10*a* and a left body 10*b* side paralysis or weakness of a user for an employment by the paraplegic user during walking independent from an external support. The right body side 10*a* and left body side 10*b* comprises a combination of right body side and left body side assisted walking devices 10 in FIG. 12. An alternative embodiment of the paraplegic assisted walking device in FIG. 12 comprises a combination of right body side and left body side assisted walking devices 11.

In FIG. 12 the right body side assisted walking device comprises a right body side vertically oriented support rod, with an upper right body side retainer attached at or near to an upper vertical end of the right body side vertically oriented support rod, with the upper right body side retainer configured to secure the user in a forward walking direction and a rearward standing position. In some embodiments of the invention the upper right body side retainer may be combined with the upper left body side retainer to form a unitary upper body retainer for both the right and left body side assisted walking devices. A right body side hand grip assembly is attached to the right body side vertically oriented support rod at a vertical height below the upper right body side retainer and configured for a user right body side upper limb employment on the right body side. In some embodiments of the invention the right body side hand grip assembly may be combined with the left body side hand grip assembly to form a unitary hand grip assembly for both the right and left body side assisted walking devices. A right knee support assembly is attached to the right body side vertically oriented support rod and configured for a user's right body side lower limb engagement below a right patella region on the right body side. The right knee support assembly has a forward walking direction right knee support structure and an open rearward right knee support structure configured for a release of the user from the right knee support assembly. A lower vertical end of the right body side vertically oriented support rod has a right body side vertically oriented support rod pivotal attachment to a right body side horizontally oriented support structure having an inner right body side horizontally oriented support structure end and an outer right body side horizontally oriented support structure end. The right body side vertically oriented support rod pivotal attachment to the right body side horizontally oriented support structure is disposed between the inner right body side horizontally oriented support structure end and the outer right body side horizontally oriented support structure end and configured for a right body side lateral gait plane rotation in a right body side lateral gait plane perpendicular to the forward walking direction. An active right body side lateral gait force limit assembly is configured to limit a right body side lateral gait motion angle of rotation of the right body side vertically oriented support rod at the right body side vertically oriented support rod pivotal attachment and to return the right body side vertically oriented support rod to a vertical orientation. A right foot support is configured for a user's right foot engagement on the right body side. The foot support is pivotally attached to the inner horizontally oriented support structure end for a rotation of the foot support in a plane parallel to the forward walking direction independent of a movement of the right body side horizontally oriented support rod. At least one right body side horizontal leveler is connected to the outer right body side horizontally oriented support structure end, with the at least one right body side horizontal leveler configured to maintain the horizontally oriented support structure in a horizontal plane during the employment of the human paraplegic assisted walking device.

In FIG. 12 the left body side assisted walking device comprises a left body side vertically oriented support rod, with an upper left body side retainer attached at or near to an upper vertical end of the left body side vertically oriented support rod, with the upper left body side retainer configured to secure the user in a forward walking direction and a rearward standing position. As mentioned above in some embodiments of the invention the upper left body side retainer may be combined with the upper right body side retainer to form a unitary upper body retainer for both the right and left body side assisted walking devices. A left body side hand grip assembly is attached to the left body side vertically oriented support rod at a vertical height below the upper left body side retainer and configured for a user left body side upper limb employment on the left body side. As mentioned above in some embodiments of the invention the left body side hand grip assembly may be combined with the right body side hand grip assembly to form a unitary hand grip assembly for both the right and left body side assisted walking devices. A left knee support assembly is attached to the left body side vertically oriented support rod and configured for a user's left body side lower limb engagement below a left patella region on the left body side. The left knee support assembly has a forward walking direction left knee support structure and an open rearward left knee support structure configured for a release of the user from the left knee support assembly. A lower vertical end of the left body side vertically oriented support rod has a left body side vertically oriented support rod pivotal attachment to a left body side horizontally oriented support structure having an inner left body side horizontally oriented support structure end and an outer left body side horizontally oriented support structure end The left body side vertically oriented support rod pivotal attachment to the left body side horizontally oriented support structure is disposed between the inner left body side horizontally oriented support structure end and the outer left body side horizontally oriented support structure end and configured for a left body side lateral gait plane rotation in a left body side lateral gait plane perpendicular to the forward walking direction. An active left body side lateral gait force limit assembly is configured to limit a left body side lateral gait motion angle of rotation of the left body side vertically oriented support rod at the left body side vertically oriented support rod pivotal attachment and to return the left body side vertically oriented support rod to a vertical orientation. A left foot support is configured for a user's left foot engagement on the left body side. The foot support is pivotally attached to the inner horizontally oriented support structure end for a rotation of the foot support in a plane parallel to the forward walking direction independent of a movement of the left body side horizontally oriented support rod. At least one left body side horizontal leveler is connected to the outer left body side horizontally oriented support structure end, with the at least one left body side horizontal leveler configured to maintain the horizontally oriented support structure in a horizontal plane during the employment of the human paraplegic assisted walking device.

A selective combination of disclosed additional features for assisted walking device 13 or assisted walking device 11 may be combined when they are used as the right body side and the left body side assisted walking devices that form a paraplegic assisted walking device as shown, for example, in FIG. 12 for the combination of a mirror image pair of assisted walking devices 10.

There is shown in FIG. 14 through FIG. 18 one embodiment of a single leg body crutch 14 of the present invention.

Vertically oriented support rod 15 is configured for the attachment of the components of the single leg body crutch shown in the figures. In some embodiments of the invention, the vertically oriented support rod may be of a fixed overall vertical height as required for a particular user of the device. In some embodiments of the invention, vertically oriented support rod 15 is a vertical linear length of rectangular extruded aluminum T-slot structural frame configured for use with interlocking fittings for attachment of the components. In other embodiments, the vertically oriented support rod is adjustable in overall vertical height; for example, by being formed from two or more tubular sections that telescope into and out of each other to a lockable variable vertical height as required by a particular user. In some embodiments of the invention, the vertically oriented support rod may include one or more curved sections to accommodate a particular user's body shape or posture.

An upper body retainer 17 is attached at or near to the upper vertical end 15*a* of vertically oriented support rod 15 and is either fixed in location to the vertically oriented support rod with a suitable upper body retaining fastener or configured for fixing to an adjustable location along the vertical height of the vertically oriented support rod with a fastener tightening element that can be located relative to the interior or exterior of the upper body retaining fastener. In some embodiments of the invention, the attachment of the upper body retainer 17 to vertically oriented support rod 15 allows rotation of the vertically oriented support rod around the attachment in an X-Z plane when the device 14 is in use so that the vertically oriented support rod rotates independent of the attached upper body retainer. Upper body retainer 17 extends at least partially around the girth of a user's chest region to secure the user in the forward (+X) walking direction and rearward (−X) standing direction when walking with the device. In some embodiments of the invention the upper body retainer is formed from an arcuate shaped soft injection molded polymer material with expanding elasticity to comfortably secure a variable range of chest girths where the upper body retainer is positioned when in use. Alternatively the upper body retainer is formed from a shaped metal sheet and covered with a body cushioning material.

In some embodiments of the invention optional chest belt 17*a*, either of adjustable length or fixed length, is configured with a belt fastener 17*b*, such as a snap-fit buckle so that the upper body retainer remains firmly attached to the user's chest when walking by securing the upper body retainer around the entire girth of the user.

Hand grip assembly 16 is attached at position 15*b* to vertically oriented support rod 15 below upper body retainer 17 and is either securely fixed in a location to the vertically oriented support rod or configured for secured fixing to an adjustable vertical height location to the vertically oriented support rod. Hand grip 16*a* extends forward (+X direction) of the vertically oriented support rod and is of a cylindrical or tubular design in this example of the invention. In this example hand grip 16*a* is attached to the vertically oriented support rod via hand grip L-shaped fitting 16*b*. Hand grip L-shaped fitting 16*b* can be configured for an optional adjustable vertical height location relative to the vertically oriented support rod with a fastener tightening element that can be located on hand grip L-shaped fitting 16*b*. Hand grip 16*a* can be provided with an optional grip compression material over hand grip 16*a* to allow the user to firmly compression grip the hand grip.

Incapacitated leg seating assembly 50 is attached at position 15*c* to vertically oriented support rod 15 below hand grip assembly 16 and is either fixed securely in location to the vertically oriented support rod, for example, with a suitable incapacitated leg fastener or configured for secured fixing to an adjustable vertical height location to the vertically oriented support rod via lateral (Y-direction) incapacitated leg support extender 62. Lateral incapacitated leg support extender 62 may be of a fixed lateral (Y) direction length or of a variable fixed lateral direction length provided, for example, by forming the lateral incapacitated leg support from two or more interconnected tubular knee support extender sections that telescope into and out of each other to a fixed lockable variable lateral position as required by the body shape of a particular user of the assisted walking device.

In some embodiments of the invention, incapacitated leg support 52 is formed from a V-shaped or U-shaped (arcuate shaped) leg bearing material such as aluminum with a vertical leg support riser structure 56 raising the vertical height of the incapacitated leg support. In alternative embodiments of the invention incapacitated leg support 52 can be formed as an arcuate shaped soft molded polymer material with expanding elasticity to comfortably secure a variable range of incapacitated legs when the user engages the incapacitated leg support to secure the user's leg in the forward walking (X-direction) and lateral gait movement direction (Y) while walking and allows the user to easily remove the incapacitated leg from the single leg body crutch. In other embodiments of the invention an incapacitated leg securement apparatus, such as a leg belt, is provided with the incapacitated leg seating assembly to retain the leg in leg support 52.

For the example of the invention shown in the drawings a cushioning material 54 is provided over the incapacitated leg support to cushion the incapacitated leg when seated in the incapacitated leg support 52.

Incapacitated leg support extender 62 may be formed from a support structure similar to that for vertical support rod 15. For the embodiment of the invention shown in the drawings, the incapacitated leg support 52 is adjustably attached to incapacitated leg support extender 62 via vertical leg support riser structure 56 that can be compression clamped between clamping elements 58*a* and 58*b* of compression clamp 58 which is adjustably fastened to incapacitated leg support extender 62 via one or more suitable fasteners 60*a* and 60*b* that allow adjustable fastening along the lateral (Y-direction) length of the incapacitated leg support extender. In the embodiment of the invention shown in the drawings the inner end of incapacitated leg support extender 62 is pivotally attached to the vertical support rod 15 by pivot fastener 62*c* that is securely fastened through the inner end of the incapacitated leg support extender 62 and opposing support extender end brackets 62*d* and 62*e* that gird the incapacitated leg support extender and allows incapacitated leg support assembly to rotate in a Y-Z plane. Opposing support extender end brackets 62*d* and 62*e* are attached to the inner end of incapacitated leg support extender by one or more fasteners 62*a* and 62*b*.

Figure 16:
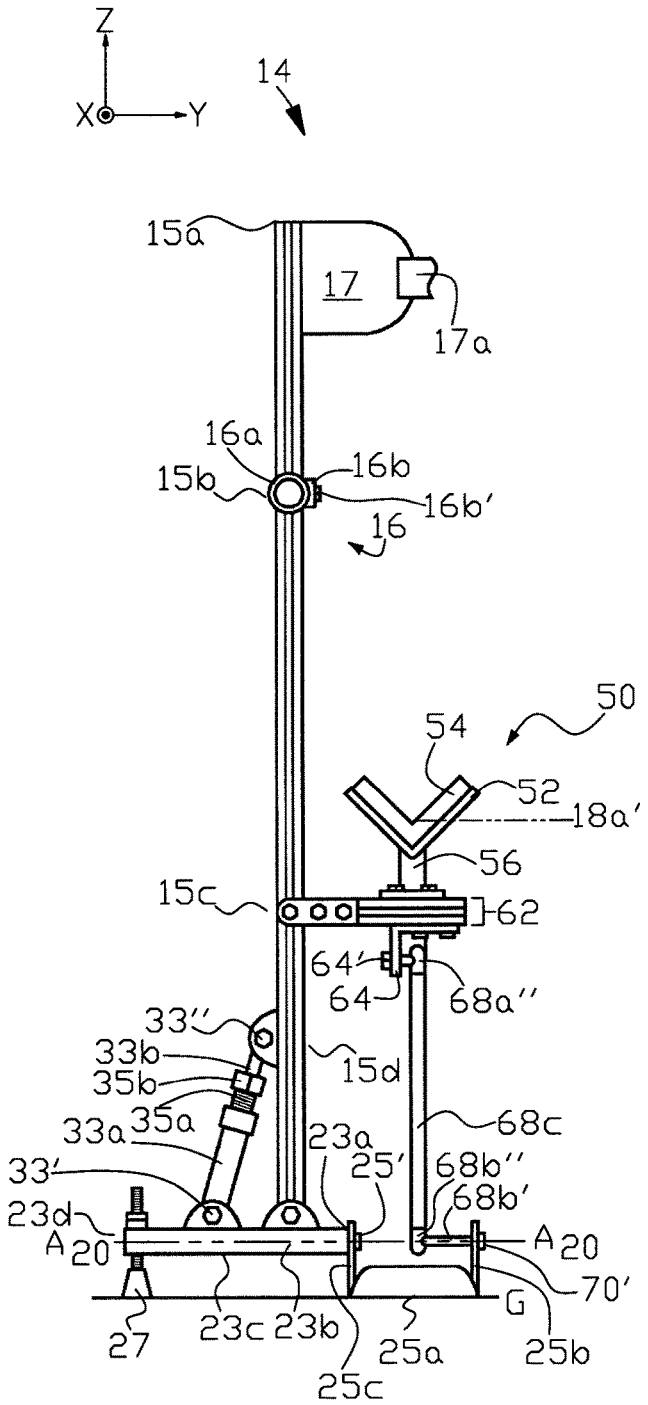
FIG. 16 is a front elevational view of the single leg body crutch shown in FIG. 14.
Figure 17:
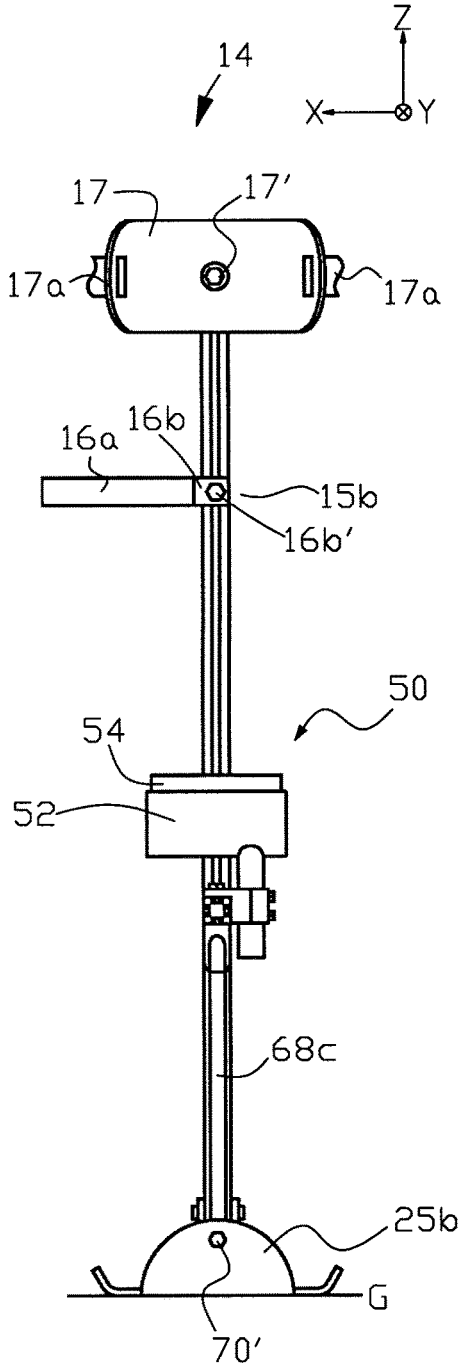
FIG. 17 is a left side elevational view of the single leg body crutch shown in FIG. 14.

Upper ball joint assembly 68*a* and lower ball joint assembly 68*b* are fastened at opposing upper and lower ends, respectively, of vertical support rod 68*c* that form upper and lower mechanical ball joints between incapacitated leg support extender 62 and incapacitated leg ground walking surface contact plate 25. In the embodiment of the invention shown in the drawings knob shaft 68*a*' of upper ball joint assembly 68*a* is rigidly connected by fastener 64' to L-shaped bracket 64 connected to incapacitated leg support extender 62 with knob in ball joint housing 68*b*" and knob shaft 68*b*' of lower ball joint assembly 68*b* is rigidly connected by fastener 70' to walking surface contact plate 25 as best seen in FIG. 16 and FIG. 17 with knob in ball joint socket housing 68*b*".

Lower vertical end 15*e* of vertically oriented support rod 15 is pivotally (in the Y lateral direction) attached to lower horizontally oriented support structure 23 at rod lower pivot joint 15*e*' located along the length (in the Y direction) of lower horizontally oriented support structure 23 at approximately mid-length location 23*b* and configured to allow rotation of the vertically oriented support rod in a Y-Z plane when the user is walking with the single leg body crutch so that the user can experience normal lateral gait motion during a gait cycle. Rod lower pivot joint 15*e*' is either fixed at location 23*b* of the lower horizontally oriented support structure 23 or configured for fixing to an adjustable location along the length of the lower horizontally oriented support structure with a rod lower end fastener tightening element provided in combination with rod lower pivot joint 15*e*'.

As shown in the figures, attached respectively at opposing lateral (Y-direction) ends 23*a* and 23*d* of the lower horizontal horizontally oriented support structure are walking surface contact plate 25 and horizontal leveler 27.

In some embodiments of the invention, walking surface contact plate 25 below the incapacitated leg is configured as a walking surface contact ski plate 25*a* with forward and aft raised ends and ski plate outside and inside side walls 25*b* and 25*c*, respectively, with an open top ski plate. The inside ski plate side wall 25*c* of the walking surface contact plate 25 is pivotally attached to inner end 23*a* of the lower horizontally oriented support structure 23 by pivot joint 25' as best seen in FIG. 16. Pivot joint 25' is configured to allow rotation of walking surface contact place 25, with the user's incapacitated leg seated in the incapacitated leg seating assembly 50, about longitudinal axis $A_{20}$ of lower horizontally oriented support structure 23 in an X-Z plane independent of the horizontally oriented support structure 23.

Vertically oriented support rod lower pivot joint 15*e*' allows vertically oriented support rod 15 to rotate in a Y-Z plane when the user's incapacitated leg is positioned in incapacitated leg seating assembly 50 with lateral direction gait movement that would naturally occur in a normal human gait walking cycle if incapacitated leg support crutch 14 was not being used. However if this lateral direction gait movement is overextended, the user would be susceptible to falling laterally (Y-direction) without the ability to recover to upright position due to the incapacitated leg. To aid in avoiding lateral falling while allowing a controlled angle of gait rotation in lateral (−Y direction) single leg body crutch 14 includes an active lateral gait force limit assembly 24. In some embodiments of the invention, the active lateral gait force limit assembly is a mechanical damper, for example a dashpot, or a pneumatic or hydraulic damper, as known in the art, in combination with a lateral motion limit device. In the embodiment of the invention shown in FIG. 14 and FIG. 15A, pneumatic or hydraulic damper assembly 33 is shown with monotube or twin tube gas or hydraulic cylinder 33*a* with damper rod 33*b* extending externally from the cylinder through lateral motion limit device 35 as best seen in FIG. 15A. In this embodiment of the invention, lateral motion limit device 35 comprises externally screw threaded pipe 35*a* joined at the end of the cylinder from which damper rod 33*b* extends and threaded lateral motion limit nut 35*b* that is adjustably screwed onto externally screw threaded pipe 35*a*. The final adjusted fixed position of nut 35*b* along the screw thread determines the maximum permissible lateral gait angle on the incapacitated leg side of the user. In the embodiment of the invention for single leg body crutch as shown in FIG. 14 to FIG. 17, the cylinder end opposite the end of the externally extended cylinder rod 33*b* is pivotally (in the Y lateral direction) attached to lower horizontally oriented support structure 23 by damper pivot joint 33' located along the length of lower horizontally oriented support structure 23 at location 23*c*, which is laterally outward of the vertically oriented support rod lower end pivot joint 15*e*'. The externally extended end of damper rod 33*b* is pivotally (in the Y direction) attached to vertically oriented support rod 15 by damper pivot joint 33" located along the length of the vertically oriented support rod 15 at location 15*d* below location 15*c* at which incapacitated leg support assembly 50 is located.

Figure 14:
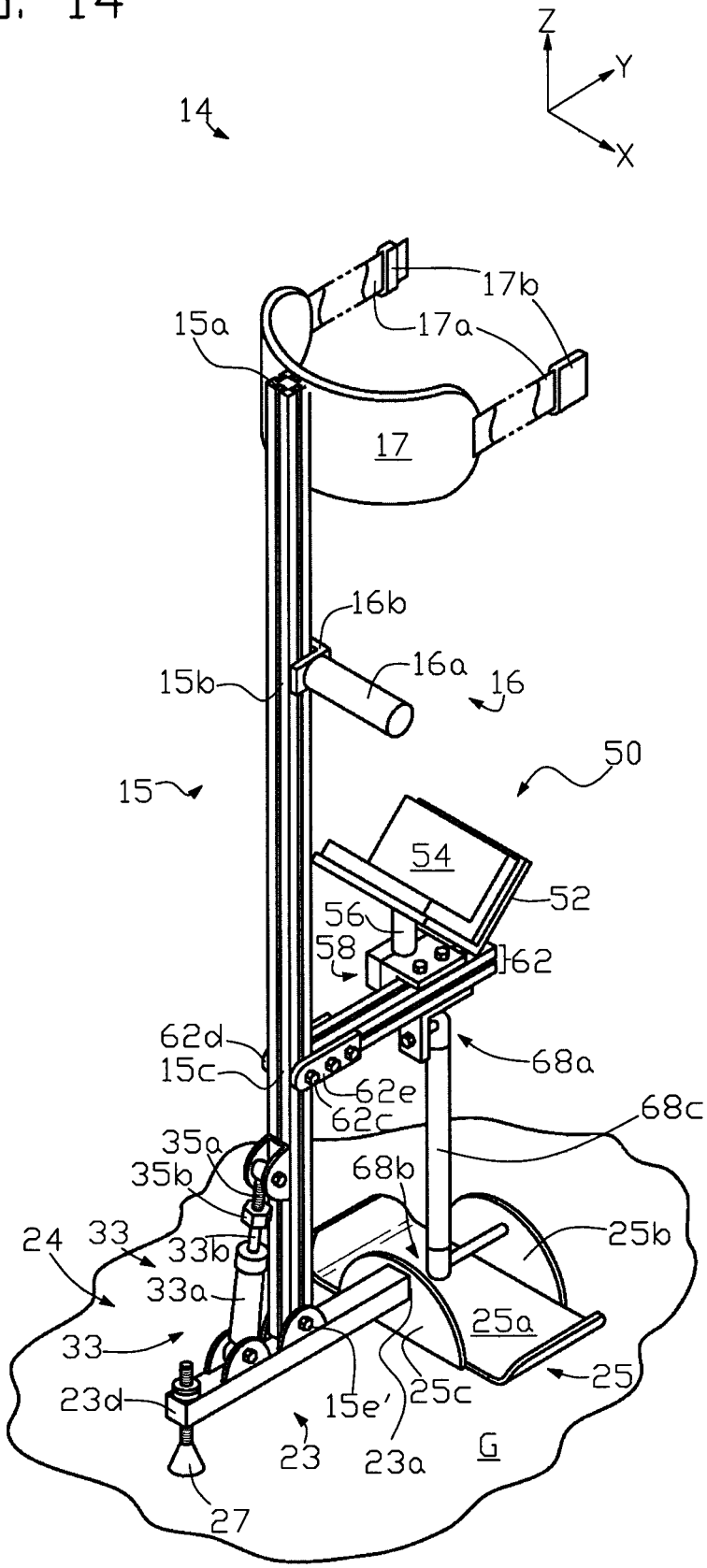
FIG. 14 is a perspective view of one embodiment of a single leg body crutch of the present invention when the single leg body crutch is in a vertical (also identified as the neutral) positon.
Figure 15B:
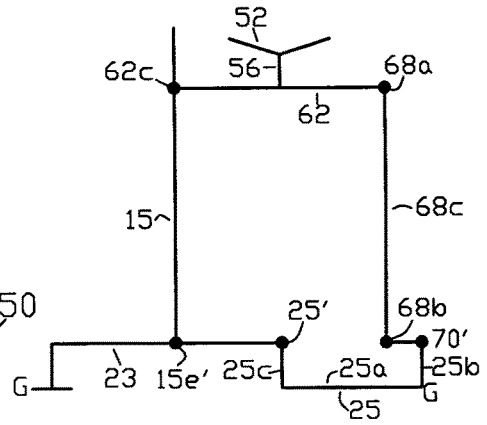
FIG. 15B is a stick diagram illustrating components of an incapacitated leg walking gait stabilizer assembly utilized in a single leg body crutch of the present invention when the stabilizer assembly is in the neutral (vertical) position shown in FIG. 14 and FIG. 15A and the stabilizer assembly forms a rectangular-like lateral plane.
Figure 15A:
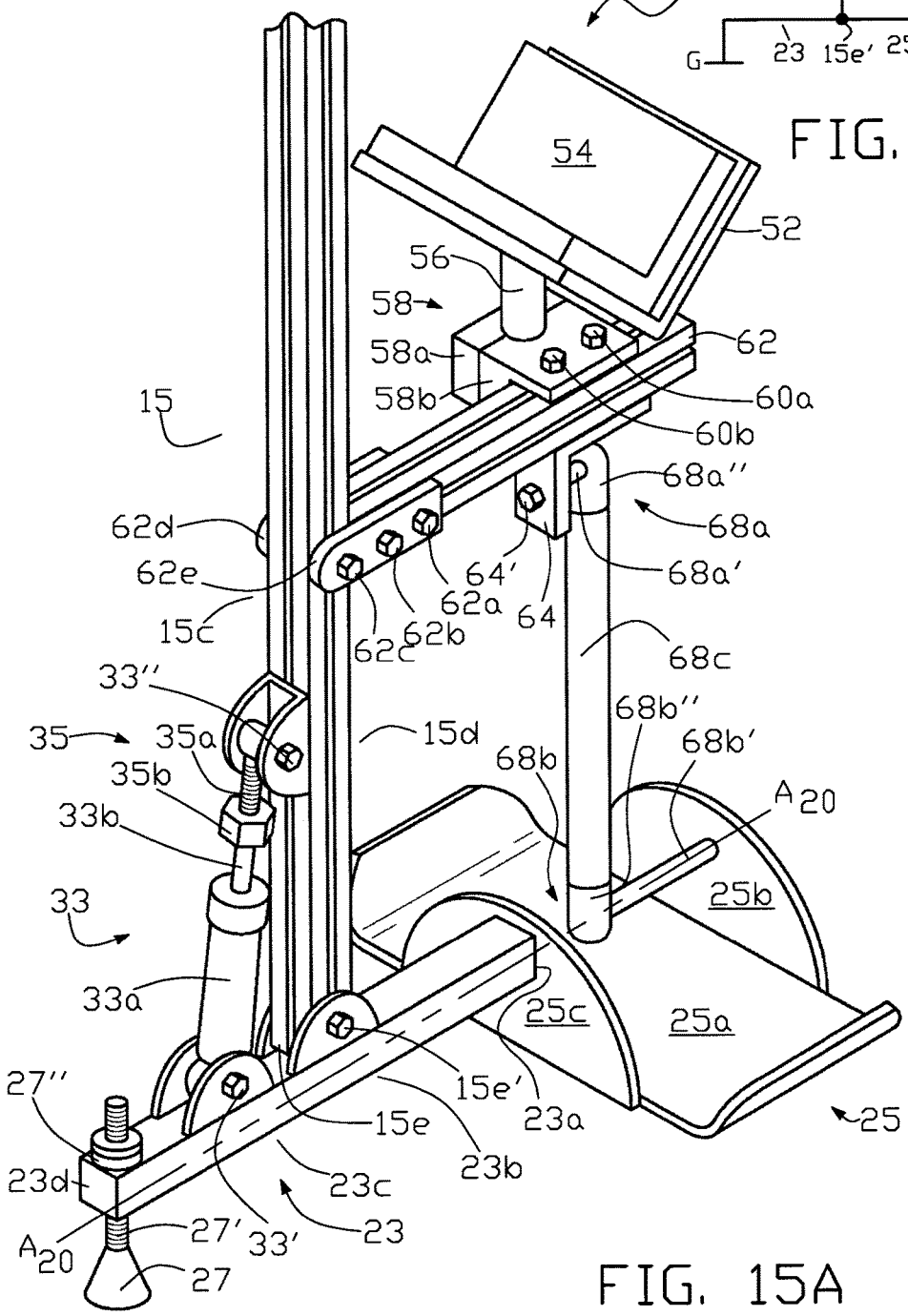
FIG. 15A is a detailed perspective view of the lower end of the single leg body crutch in FIG. 14.
Figures 15C, 15D:
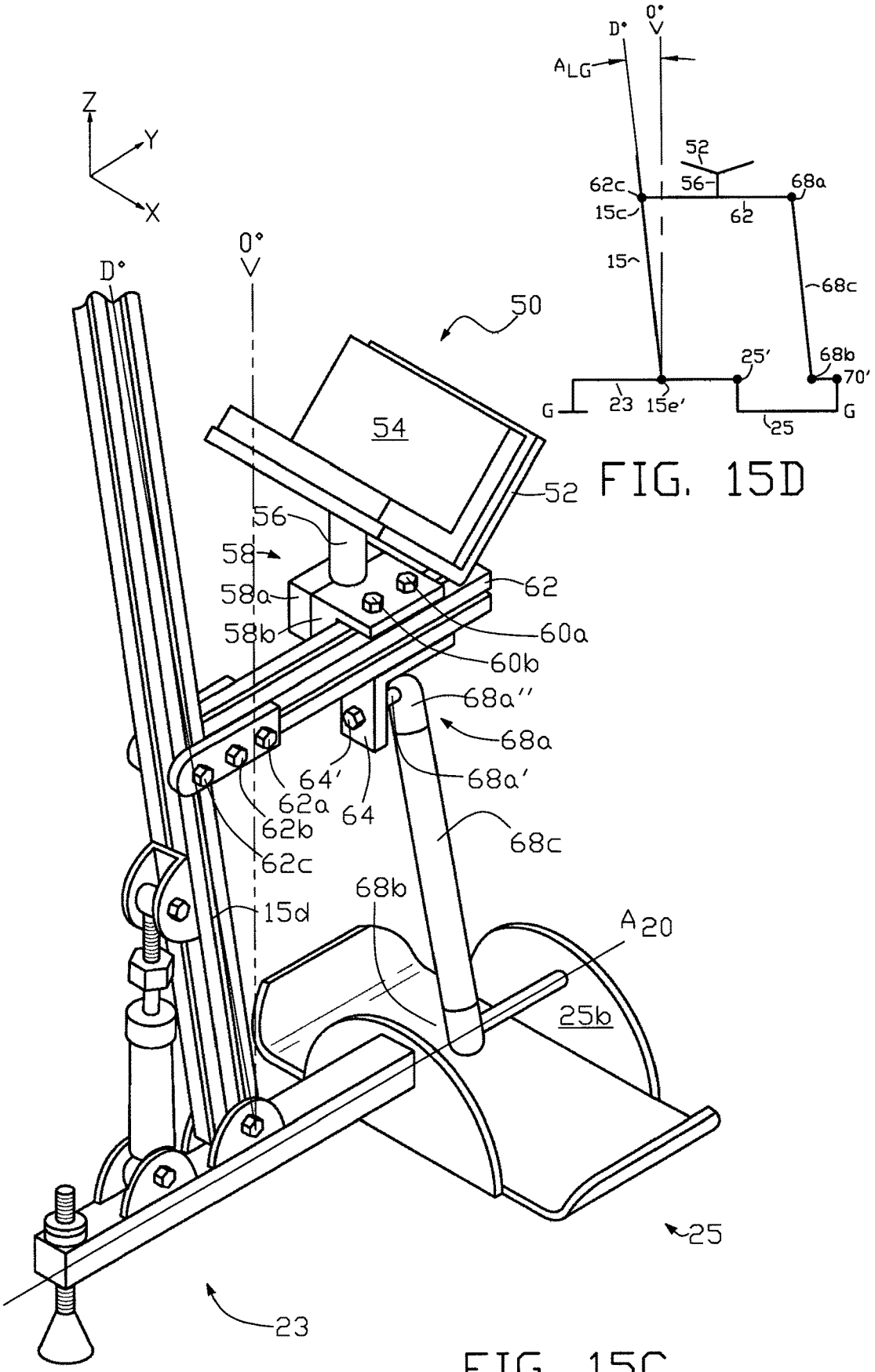
FIG. 15C is a detailed perspective view of the lower end of the single leg body crutch in FIG. 14 when the single leg body crutch is in an off-vertical (also identified as lateral gait motion) position.
FIG. 15D is a stick diagram illustrating components of an incapacitated leg walking gait stabilizer assembly utilized in a single leg body crutch of the present invention when the stabilizer assembly is in a lateral gate motion (off-vertical) position shown in FIG. 15C and the stabilizer assembly forms a parallelogram-like lateral plane.

When vertically oriented support rod 15 is at vertical position (oriented parallel with the Z-axis), as shown for example in FIG. 14, damper assembly 33 is configured so that cylinder damper rod 33*b* is at fully extended (external) stroke. When a user walks with single leg body crutch 14, during gait cycle lateral (Y) motion to the right side of vertical (the side of the incapacitated leg), externally extended damper rod 33*b* is forced into cylinder 33*a* to a maximum lateral gait angle D° when the external end of damper rod 33*b* makes contact with threaded lateral motion limit nut 35*b*. Consequently the user's lateral (−Y direction) gait motion is limited to the maximum lateral angle, for example angle $A_{LG}$ from vertical as shown in FIG. 19B, which is established by the final adjusted position of the threaded lateral motion limit nut 35*b* on the externally screw threaded pipe, and externally extended damper rod 33*b* will return the vertically oriented support rod 15 to vertical orientation as the user returns to zero degrees lateral gait angle when the vertically oriented support rod 15 is at vertical orientation.

Horizontal leveler 27 is attached to outer end 23*d* of lower horizontally oriented support structure 23 and is either fixed in vertical (Z direction) distance from the bottom of the lower horizontal support structure to ground level G, or configured for secured fixing to an adjustable vertical distance with a leveler fastener tightening element that can be located above or below the lower horizontal support structure, such as adjustable threaded rod 27' attached to leveler 27 and nut 27" attached to the horizontally oriented support structure. In some embodiments of the invention, horizontal leveler 27 is bell-shaped and maintains the lower horizontally oriented support structure horizontally oriented as the user moves through a gait cycle. In some embodiments of the invention, horizontal leveler 27 is formed from a soft high elasticity polymer that is a passive lateral (Y) direction damper that functions in conjunction with the active lateral gait force damper to limit lateral gait motion.

Figure 18B:
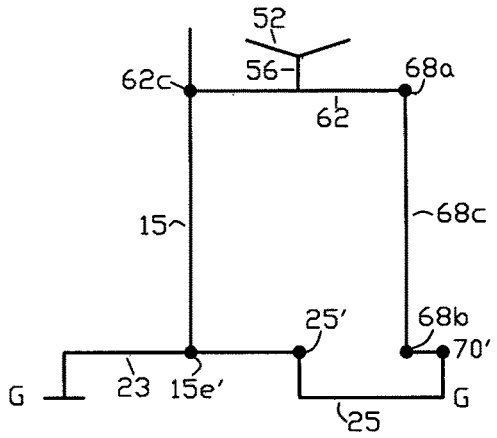
FIG. 18B is a stick diagram illustrating components forming an incapacitated leg walking gait stabilizer assembly when the stabilizer assembly is in the neutral (vertical) position shown in FIG. 18A.
Figure 18A:
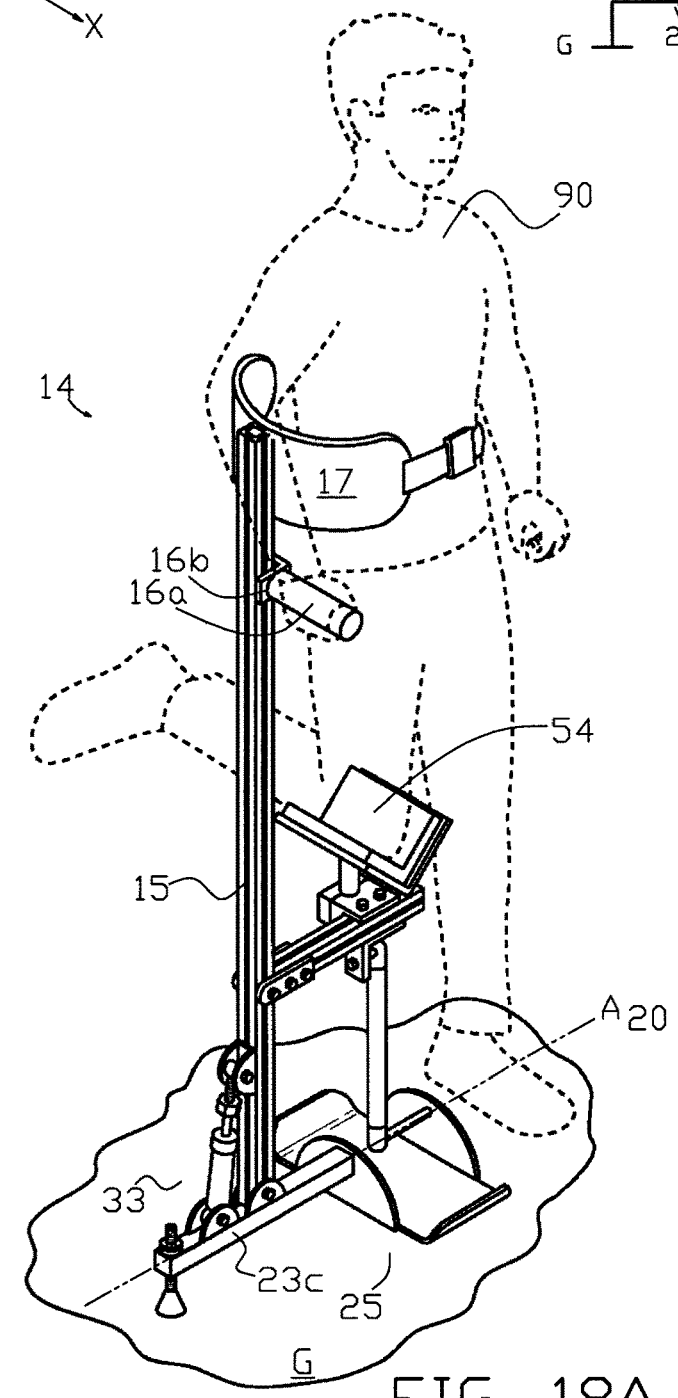
FIG. 18A is a perspective view of the single leg body crutch shown in FIG. 14 and FIG. 15A with a user mounted in (also referred to as attached to) the single leg body crutch.
Figure 18C:
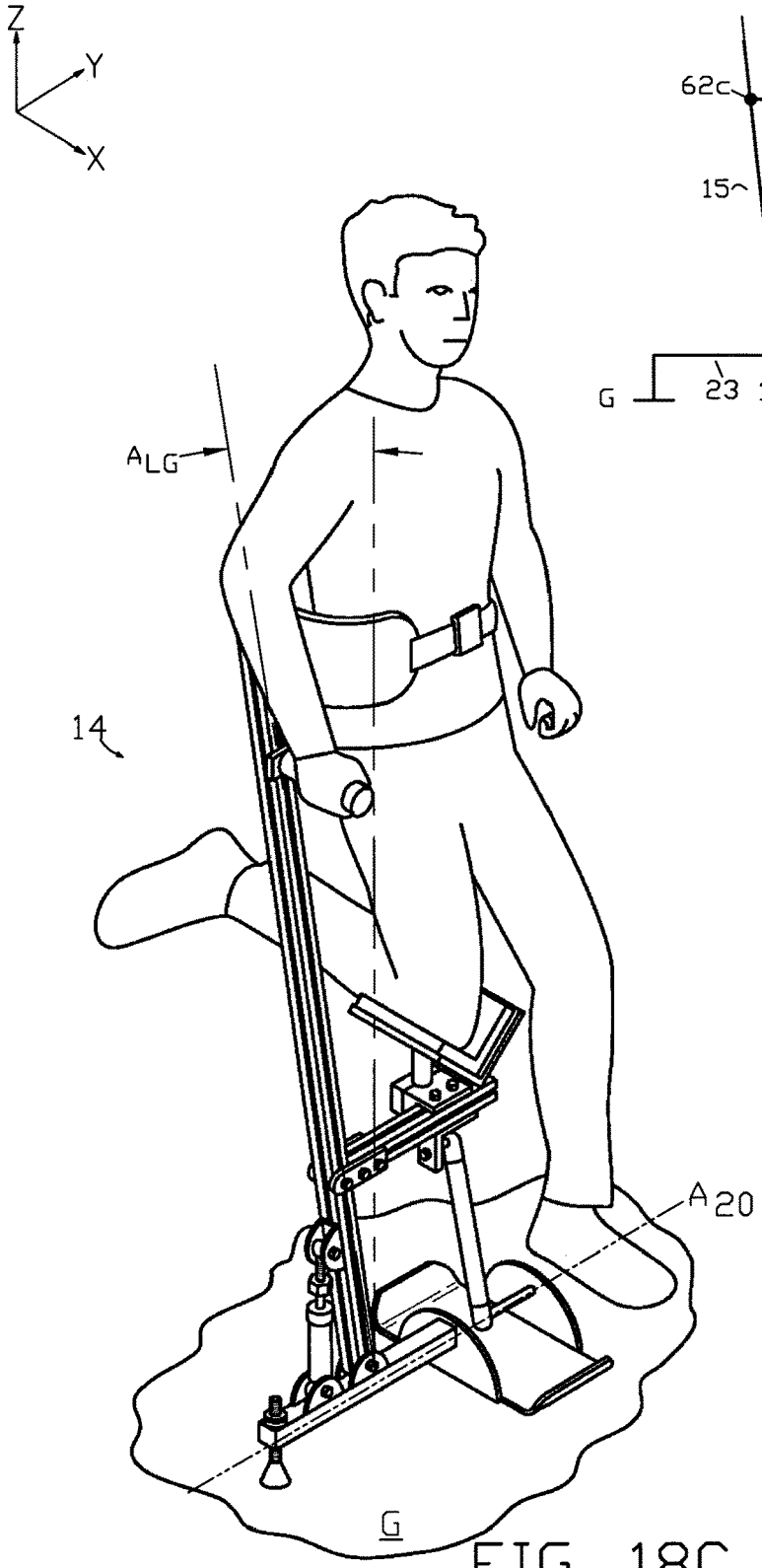
FIG. 18C is a perspective view of the single leg body crutch shown in FIG. 15C with a user mounted in the single leg body crutch and exerting a right side lateral body force on the single leg body crutch.
Figure 18D:
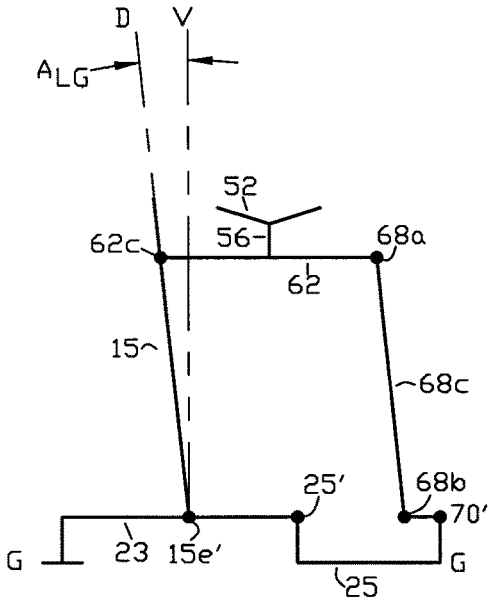
FIG. 18D is a stick diagram illustrating components forming an incapacitated leg walking gait stabilizer assembly when the stabilizer assembly is in a lateral gate motion (off-vertical) position shown in FIG. 18C.

FIG. 18A and FIG. 18C illustrate one example of user 90 employing the use of a single incapacitated leg crutch 14 shown in FIG. 14 to FIG. 17 without external support from an external device or individual. In FIG. 18A the user 90 is mounted in single incapacitated leg crutch 14 and shown with the user and the crutch in vertically oriented position when the incapacitated leg walking gait stabilizer assembly is in the upright vertical configuration as further detailed stick diagram FIG. 18B. In FIG. 18C the user and the crutch are oriented at a lateral (Y) gait angle of $A_{LG}$ from vertical as the user moves laterally in the direction of the incapacitated leg when the incapacitated leg walking gait stabilizer assembly rotates laterally as further detailed in stick diagram FIG. 18D before returning to the upright vertical configuration in FIG. 18A and FIG. 18B when the user completes lateral gait movement in the direction of the incapacitated leg.

Figures 19A, 19B, 19C:
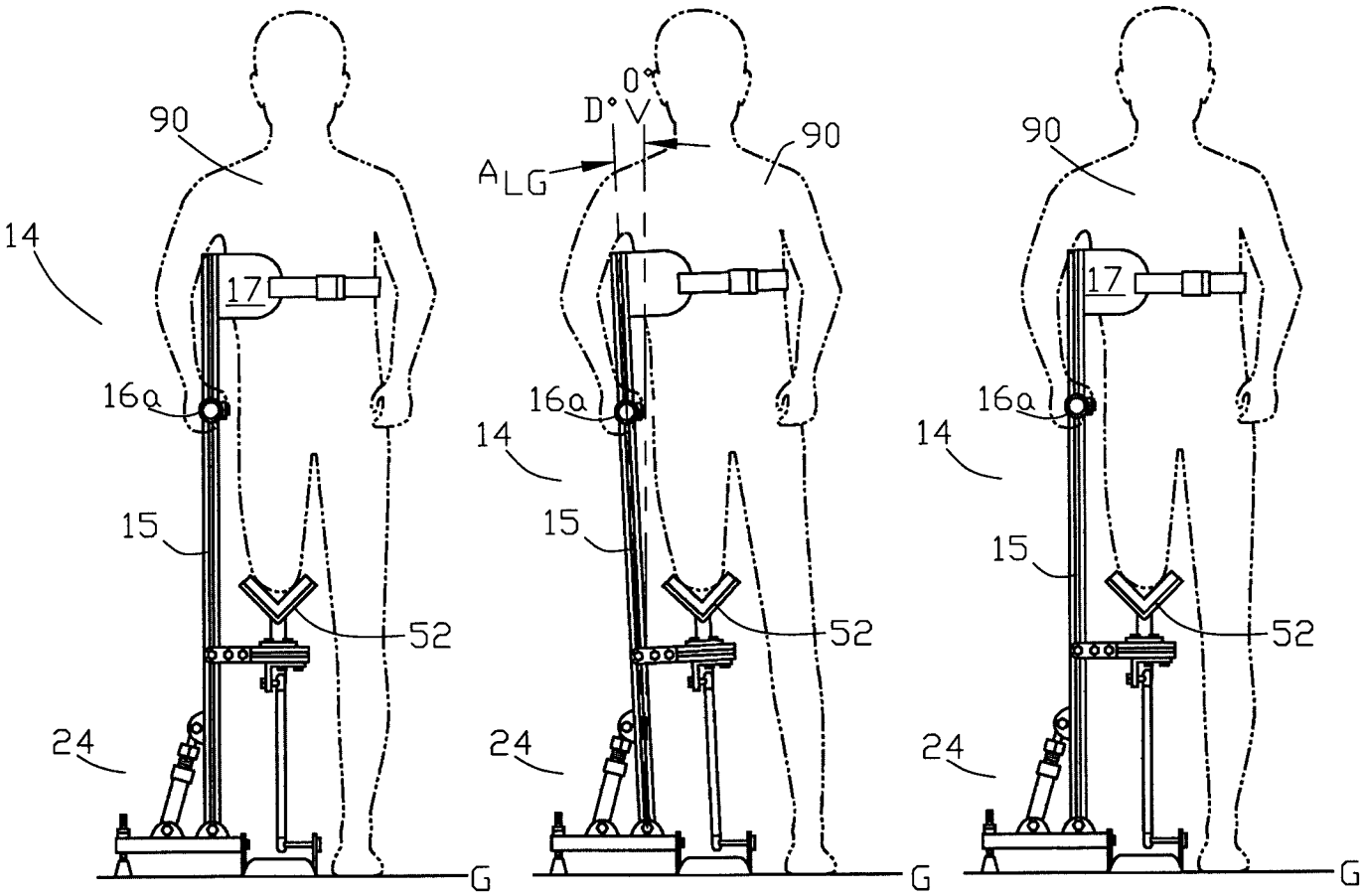
FIGS. 19A, 19B and 19C are front elevation views of employment of the single leg body crutch in FIG. 14 with the user mounted in the crutch and walking forward through a gait cycle with the single leg body crutch.

FIG. 19A through FIG. 19C illustrate lateral movement through the angle $A_{LG}$ as the user's single incapacitated leg (right side leg in this example) is brought forward by single leg body crutch 14 during a partial gait walking cycle.

Figures 20A, 20B, 20C:
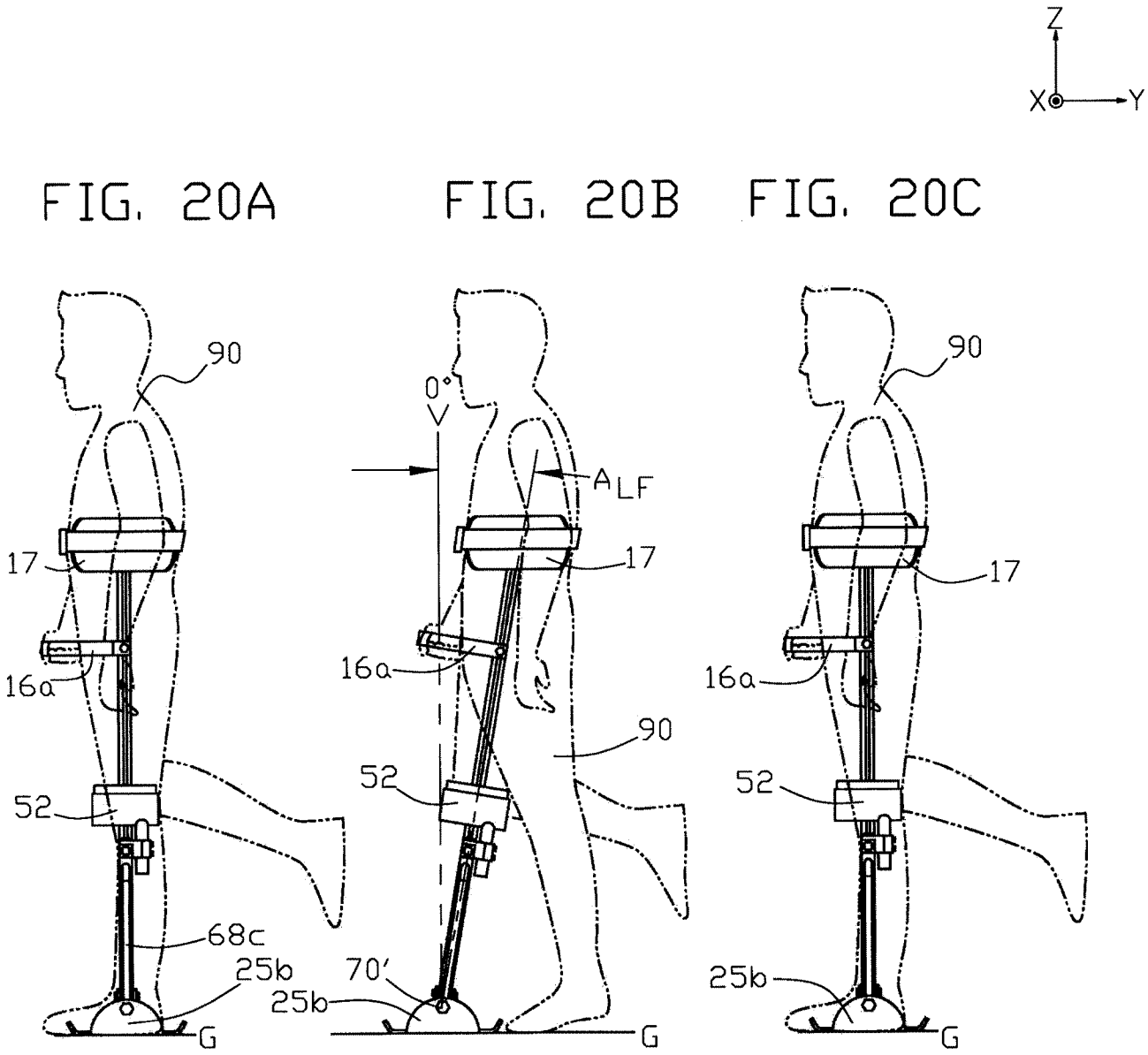
FIGS. 20A, 20B and 20C are left side elevation views corresponding to the side elevation views in FIGS. 19A, 19B and 19C of employment of the single leg body crutch in FIG. 14 with the user mounted in the crutch and walking forward through a gait cycle with the single leg body crutch.

FIG. 20A through FIG. 20C illustrate lateral forward angle $A_{LF}$ motion as the user's single incapacitated leg is brought forward by single leg crutch 14 during a partial gait walking cycle.

In FIG. 19A and FIG. 20A the user's weight is primarily over the left (non-incapacitated leg in this example) and the right (incapacitated leg) is not weight loaded with the user's right hand engaging hand grip 16*a* to move single leg body crutch 14 in the forward direction with the right incapacitated leg seated in single leg body crutch 14.

In FIG. 19B and FIG. 20B single leg body crutch 14 with the incapacitated right leg pivots forward around upper body retainer 17 pivot connection to vertically oriented support rod 15. The left leg pushes forward and laterally to shift the user's weight over the incapacitated right leg. Device 14 pivots laterally and forward around the horizontally oriented support structure 23 while the active lateral gait force limit assembly operates to control and limit the lateral gait movement. Incapacitated leg support assembly 50 maintains the user in an upright position through the gait cycle as the user's weight proceeds primarily over the right incapacitated leg. Without the left leg weight loaded, the user can swing the left leg forward while the active lateral gait force limit assembly is forcing the vertically oriented support rod 15 to vertical while the user's weight shifts back to the left leg as shown in transition from FIG. 19B and FIG. 20B to FIG. 19C and FIG. 20C when a repeat forward gait cycle can be performed as shown in FIG. 19A and FIG. 20A to FIG. 19B and FIG. 20B and described herein.

Figure 21A:
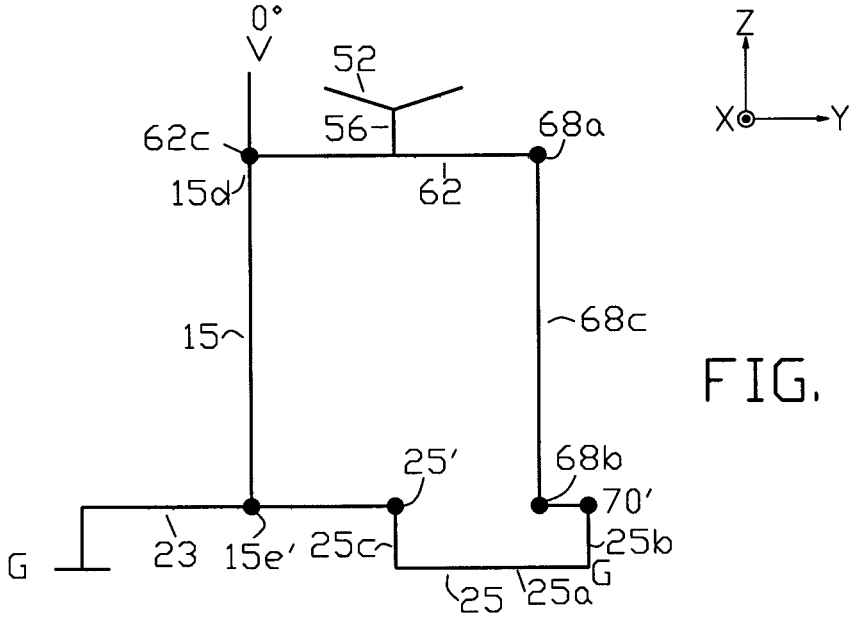
FIG. 21A is a stick diagram illustrating components forming an incapacitated leg walking gait stabilizer assembly when the stabilizer assembly is in the neutral (vertical) position.
Figure 21B:
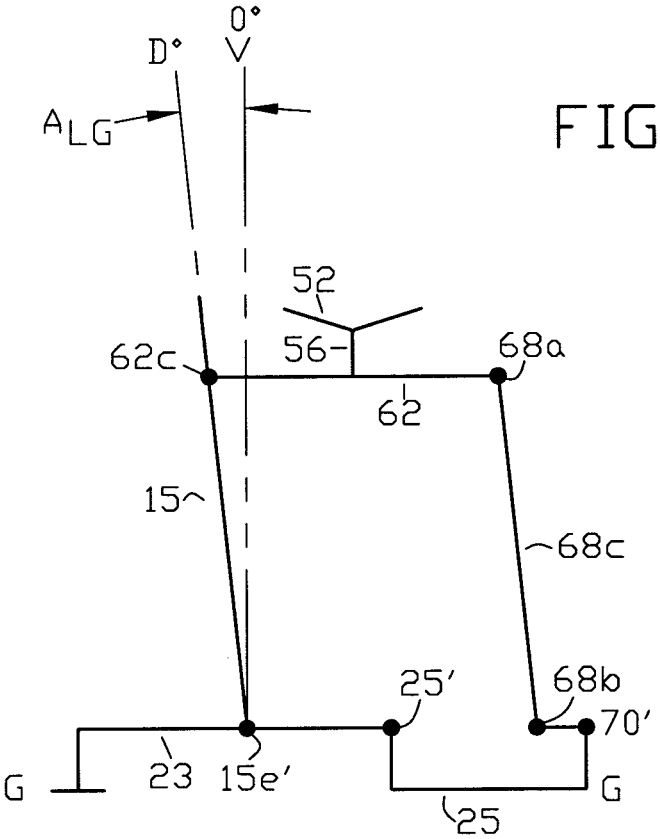
FIG. 21B is a stick diagram illustrating components forming an incapacitated leg walking gait stabilizer assembly when the stabilizer assembly is in a lateral gate motion (off-vertical) position.
Figure 22:
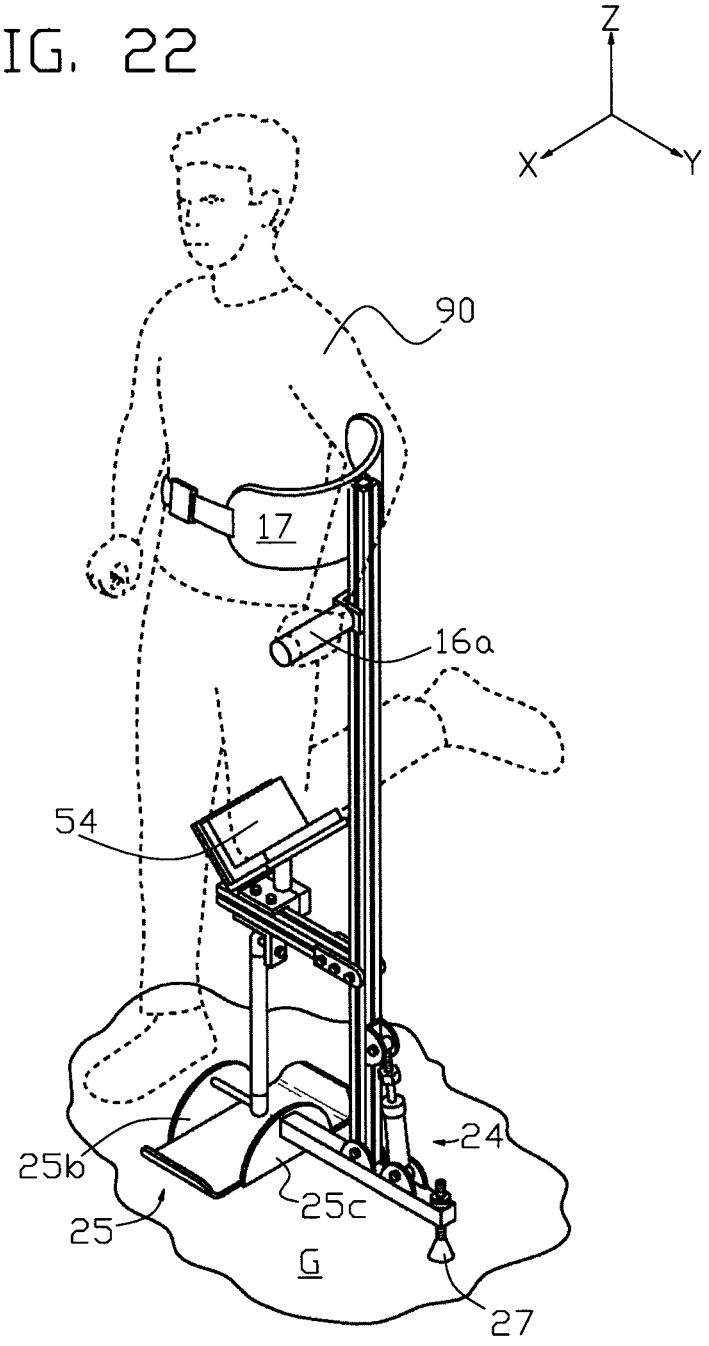
FIG. 22 is a perspective view of one embodiment of a single leg body crutch of the present invention that is a mirror image of the single leg body crutch shown in FIG. 14 where the incapacitated leg is opposite the incapacitated leg accommodated in the single leg body crutch shown in FIG. 14.

FIG. 21A and FIG. 22A are stick diagrams illustrating incapacitated leg walking gait stabilizer assembly pivoting and rotating between user vertical orientation in FIG. 21A to user lateral gait motion orientation in FIG. 21B in one example of the present invention to stabilize the incapacitated user's lateral gait movement to the incapacitated leg side of the user's body and forward gait movement while walking with the single leg body crutch. The incapacitated leg walking gait stabilizer assembly in vertical orientation in FIG. 21A forms a structural assembly similar in shape to a rectangle operably formed by lateral incapacitated leg support extender 62 connected at a first end to upper ball joint assembly 68*a*; which is connected to the upper end of vertical support rod 68*c* with the opposing lower end of vertical support rod 68*c* connected to lower ball joint assembly 68*b*; which is connected by fastener 70' with walking surface contact plate 25; which is pivotally connected to pivot joint 25' at inner end 23*a* of lower horizontally oriented support structure 23; to which the lower vertical end 15*e* of vertically oriented support rod 15 is pivotally attached at rod lower pivot joint 15*e'* with the second end of lateral incapacitated leg support extender 62 pivotally connected to vertically oriented support rod 15 at position 15*d* by pivot fastener 62*c* to complete the rectangular-like shape of the incapacitated leg walking gait stabilizer assembly in vertical orientation. Pivotal joint connections 15*e'* and 62*c* in combination with ball joints 68*a* and 68*b* allow the incapacitated leg walking gait stabilizer assembly to move laterally through the parallelogram-like motion shown in FIG. 21B as the user moves through lateral gait movement of a walking gait cycle with return to the horizontal orientation shown in FIG. 21A for forward gait movement of the walking gait cycle.

A single incapacitated leg crutch of the present invention can be employed, for example, by a user who cannot support body weight with an incapacitated leg, for example, as shown in the figures, or a partial leg amputee with the partially amputated leg seated in the single incapacitated leg crutch of the present invention.

The above examples of the invention describe a single incapacitated leg crutch for a right incapacitated leg. Single incapacitated leg crutches for a left incapacitated leg of the present invention are mirror images devices of those disclosed for right incapacitated leg as shown, for example, in FIG. 22.

In some embodiments of the invention, one or more of the components forming the assisted walking device can be formed as a unitary structure fabricated from a carbon fiber reinforced polymer.

Reference throughout this specification to "one example or embodiment," "an example or embodiment," "one or more examples or embodiments," or "different example or embodiments," for example, means that a particular feature may be included in the practice of the invention. In the description various features are sometimes grouped together in a single example, embodiment, figure, or description thereof for the purpose of streamlining the disclosure and aiding in the understanding of various inventive aspects.

The present invention has been described in terms of preferred examples and embodiments. Equivalents, alternatives and modifications, aside from those expressly stated, are possible and within the scope of the invention. Those skilled in the art, having the benefit of the teachings of this specification, may make modifications thereto without departing from the scope of the invention.

The invention claimed is:

1. A single incapacitated leg walking crutch for an employment by a user with a single incapacitated leg during walking independent from an external support, the single incapacitated leg walking crutch comprising:

a vertically oriented support rod;

an upper body retainer attached at or near to an upper vertical end of the vertically oriented support rod, the upper body retainer configured to secure the user in a forward walking direction and a rearward standing position;

a hand grip assembly attached to the vertically oriented support rod at a hand grip vertical height below the upper body retainer, the hand grip assembly configured for a user upper limb employment on a body side of the single incapacitated leg;

an incapacitated leg seating assembly configured for a pivotal attachment to the vertically oriented support rod at a seating height below the hand grip assembly and configured for a seating of the single incapacitated leg;

a lower vertical end of the vertically oriented support rod having a vertically oriented support rod pivotal attachment to a horizontally oriented support structure having an inner horizontally oriented support structure end and an outer horizontally oriented support structure end, the vertically oriented support rod pivotal attachment to the horizontally oriented support structure disposed between the inner horizontally oriented support structure end and the outer horizontally oriented support structure end and configured for a lateral gait plane rotation in a lateral gait plane perpendicular to the forward walking direction;

an incapacitated leg walking gait stabilizer assembly connected to the incapacitated leg seating assembly, the incapacitated leg walking gait stabilizer assembly configured for a lateral and a forward walking controlled gait movement of the user over a walking surface;

an active lateral gait force limit assembly configured to limit a lateral gait motion angle of rotation of the vertically oriented support rod at the vertically oriented support rod pivotal attachment and to return the vertically oriented support rod to a vertical orientation;

an incapacitated leg walking surface support configured for a walking weight bearing below the seating of the single incapacitated leg, the incapacitated leg walking surface support attached between the inner horizontally oriented support structure end and the incapacitated leg walking gait stabilizer assembly for a rotation of the incapacitated leg walking surface support in a plane parallel to the forward walking direction independent of a movement of the horizontally oriented support structure; and at least one horizontal leveler connected to the outer horizontally oriented support structure end, the at least one horizontal leveler configured to maintain the horizontally oriented support structure in a horizontal plane during the employment of the single incapacitated leg walking crutch.

2. A single incapacitated leg walking crutch of claim 1 wherein the vertically oriented support rod comprises a rectangular extruded aluminum T-slot structural frame.

3. A single incapacitated leg walking crutch of claim 1 wherein the vertically oriented support rod comprises at least two support rod sections adjustably interconnected to adjust an overall vertical height of the vertically oriented support rod.

4. A single incapacitated leg walking crutch of claim 1 wherein the vertically oriented support rod comprises at least one curved section configured to the user.

5. A single incapacitated leg walking crutch of claim 1 wherein the upper body retainer comprises an arcuate shaped soft injection molded polymer material having an expanding elasticity configured for a variable range of chest girths of the user.

6. A single incapacitated leg walking crutch of claim 5, the upper body retainer including a chest belt configured with a belt fastener to secure the upper body retainer around an entire girth of the user.

7. A single incapacitated leg walking crutch of claim 1 wherein the upper body retainer is configured for an adjustable vertical height securement to the vertically oriented support rod.

8. A single incapacitated leg walking crutch of claim 1 wherein the active lateral gait force limit assembly comprises a mechanical damper or dashpot disposed in the lateral gait plane, the mechanical damper or dashpot connected between the vertically oriented support rod and the horizontally oriented support structure between the vertically oriented support rod pivotal attachment and the outer horizontally oriented support structure end.

9. A single incapacitated leg walking crutch of claim 1 wherein the active lateral gait force limit assembly comprises a pneumatic or hydraulic damper and a lateral gait motion limit device.

10. A single incapacitated leg walking crutch of claim 1 wherein the active lateral gait force limit assembly comprises:

a gas or hydraulic cylinder having an external damper rod extending from a second cylinder end to an extended damper rod end, a first cylinder end opposing the second cylinder end pivotally attached to the horizontally oriented support structure between the vertically oriented support rod pivotal attachment and the outer horizontally oriented support structure end and the extended damper rod end pivotally attached to the vertically oriented support rod to damper the lateral gait plane rotation;

an externally screw threaded pipe section disposed around the external damper rod and connected to the second cylinder end; and a threaded lateral gait motion limit nut adjustably positioned on the externally screw threaded pipe section at a maximum lateral gait angle position configured to block further retraction of the external damper rod into the gas or hydraulic cylinder and thereby block further lateral gait plane rotation.

11. A single incapacitated leg walking crutch of claim 1, the incapacitated leg seating assembly comprising:

an incapacitated leg support configured for the seating of the incapacitated leg;

a vertical leg support structure riser configured for adjusting a leg support vertical height; and an incapacitated leg support extender configured for the pivotal attachment of the incapacitated leg support to the vertically oriented support rod.

* * * * *